US012372085B2

(12) United States Patent
Williams

(10) Patent No.: US 12,372,085 B2
(45) Date of Patent: Jul. 29, 2025

(54) AUTOMATED LAND TRUCK PRESSURE TEST

(71) Applicant: Halliburton Energy Services, Inc., Houston, TX (US)

(72) Inventor: Derek R. Williams, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 434 days.

(21) Appl. No.: 17/980,299

(22) Filed: Nov. 3, 2022

(65) Prior Publication Data

US 2024/0151219 A1 May 9, 2024

(51) Int. Cl.

| | |
|---|---|
| ***F04B 51/00*** | (2006.01) |
| ***E21B 33/14*** | (2006.01) |
| ***E21B 41/00*** | (2006.01) |
| ***F04B 49/06*** | (2006.01) |

(52) U.S. Cl.

CPC ..... *F04B 51/00* (2013.01); *E21B 33/14* (2013.01); *E21B 41/00* (2013.01); *F04B 49/065* (2013.01)

(58) Field of Classification Search

CPC .. E21B 41/00; E21B 43/0175; E21B 43/2607; E21B 33/14; F04B 49/065; F04B 51/00; F04B 15/02

See application file for complete search history.

(56) References Cited

U.S. PATENT DOCUMENTS

| | | | |
|---|---|---|---|
| 10,253,625 B2 | 4/2019 | Williams et al. | |
| 10,280,729 B2 * | 5/2019 | Livescu | E21B 10/00 |
| 10,392,918 B2 | 8/2019 | Harkless et al. | |
| 11,643,908 B1 * | 5/2023 | Williams | E21B 41/00 166/250.01 |
| 2017/0211569 A1 | 6/2017 | Urdaneta et al. | |

(Continued)

FOREIGN PATENT DOCUMENTS

| | | |
|---|---|---|
| KR | 101154275 B1 | 6/2012 |
| WO | 2011095935 A2 | 11/2011 |
| WO | 2020227688 A1 | 12/2020 |

OTHER PUBLICATIONS

Foreign Communication from Related Application—International Search Report and Written Opinion of the International Searching Authority, International Application No. PCT/US2023/032799, dated Dec. 28, 2023, 12 pages.

(Continued)

*Primary Examiner* — An H Do

(74) *Attorney, Agent, or Firm* — Conley Rose, P.C.; Rodney B. Carroll

(57) ABSTRACT

A method of determining a health status of the various components of the pumping equipment on a pump unit may include an automatic diagnostic process with one or more diagnostic tests executing on a unit controller. One or more of the diagnostic tests can establish a flow path through the piping network comprising a supply pump and a sensor valve. The diagnostic test can include positioning the sensor valve in a first and second position while operating the pump to communicate a fluid via the flow loop. The method includes comparing a set of results of the diagnostic test to an operational indicator set, determining the health status based upon the comparison, and outputting indicia of the health status of the pumping equipment.

20 Claims, 9 Drawing Sheets

(56) References Cited

U.S. PATENT DOCUMENTS

2018/0258736 A1 9/2018 Urdaneta

OTHER PUBLICATIONS

Foreign Communication from Related Application—International Search Report and Written Opinion of the International Searching Authority, International Application No. PCT/US2023/032800, dated Jan. 2, 2024, 11 pages.

Filing Receipt, Specification and Drawings for U.S. Appl. No. 17/980,288, filed Nov. 3, 2022, entitled "Automated Pump Truck Confirmation Test," 88 pages.

* cited by examiner

AUTOMATED LAND TRUCK PRESSURE TEST

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In oil and gas wells a primary purpose of a barrier composition such as cement or a sealant is to isolate the formation fluids between zones, also referred to as zonal isolation and zonal isolation barriers. Cement is also used to support the metal casing lining the well, and the cement provides a barrier to prevent the fluids from damaging the casing and to prevent fluid migration along the casing.

Typically, an oil well is drilled to a desired depth with a drill bit and mud fluid system. A metal pipe (e.g., casing, liner, etc.) is lowered into the drilled well to prevent collapse of the drilled formation. Cement is placed between the casing and formation with a primary cementing operation. One or more downhole tools may be connected to the casing to assist with placement of the cement.

In a primary cementing operation, a cement blend tailored for the environmental conditions of the wellbore is pumped into the wellbore. This pumping operation may utilize pumping equipment, which may include a plurality of components controlled by a controller such as valves and pumping equipment. The equipment and plurality of components may require routine maintenance and, in some cases, repair of one or more components. Personnel may perform a diagnostic testing of one or more of these components before a job, although the data generated about the operation of these components is not necessarily conclusive as to the capacity of those components to complete the intended job, nor is the data necessarily indicative of the operational condition of the equipment. Improved methods of determining the operational condition of the pumping equipment are needed.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 6B is a block diagram of a 5G core network according to an embodiment of the disclosure.

DETAILED DESCRIPTION

Figure 1:
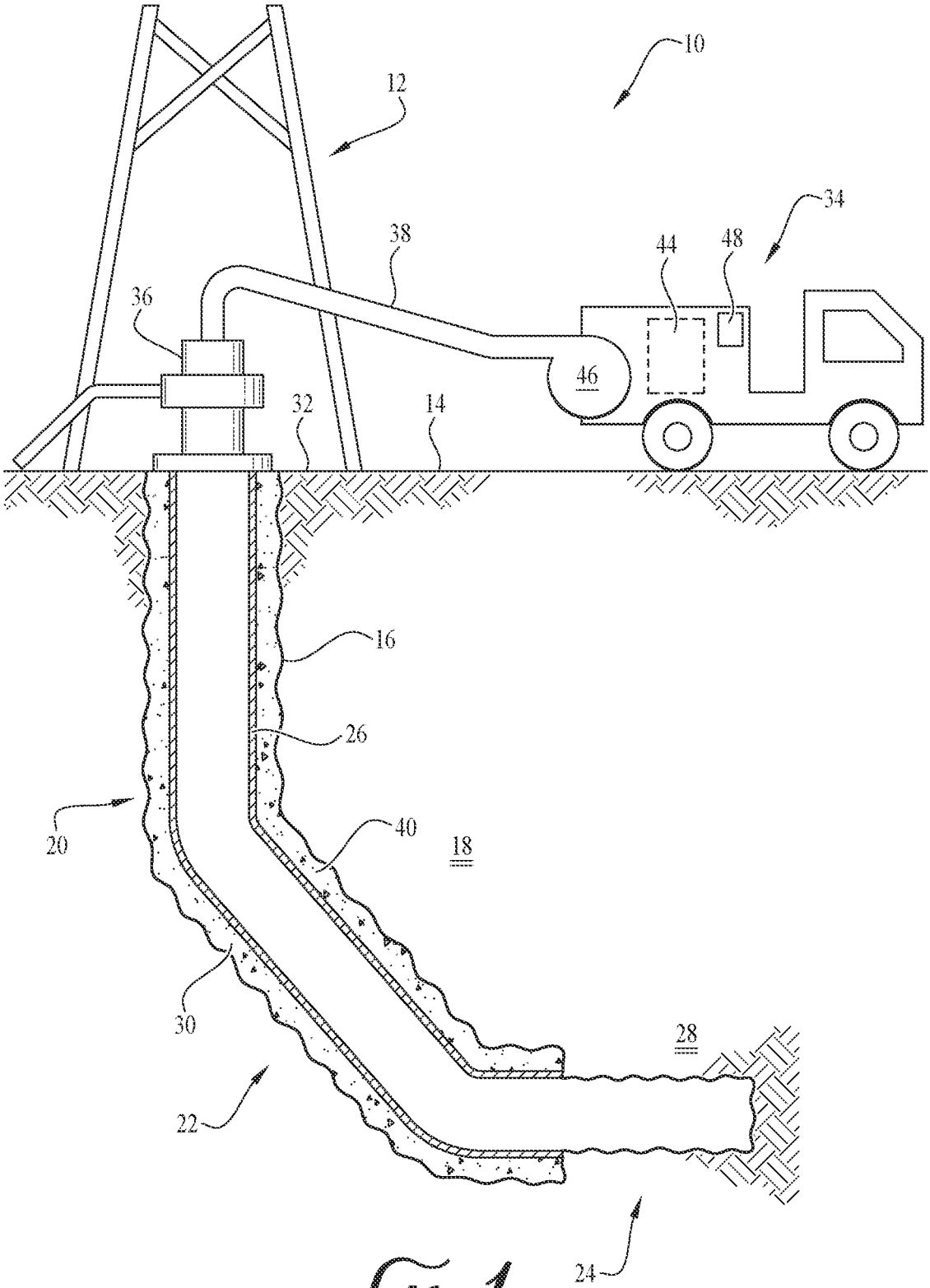
FIG. 1 is an illustration of an operating environment at a wellsite according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Oil well construction can follow a series of construction stages including drilling, cementing, and completion or stimulation. Each stage can be carried out using specialized equipment and materials to complete each stage.

Examples of the equipment that may be used at these stages include various configurations, types, and/or sizes of pumping equipment. For example, during the drilling stage, an oil well can be drilled with a drill bit, a mud system, and a mud pump. As the drill bit penetrates the earth strata, a drilling mud is pumped down a drill string to bring cuttings back to the surface, an example of which includes a reciprocating (e.g., plunger-type) pump. The mud pumping equipment may include a mixing system for blending dry mud blend with a liquid, e.g., water, to produce a mud slurry.

Also, for example, during the cementing stage, a cement pump may be used to introduce a cementitious slurry, e.g., a cement composition, into the annulus formed between the casing and the wellbore. The cement typically used for cementing oil wells can be a Portland cement comprised of a hydraulic cement with a source of free lime and alkali ions, a source of calcium carbonate, a source of calcium sulfate and an organic component. The mixing system can blend the dry cement with water to produce the cement slurry.

In another example, during the completion and/or stimulation stage, a blender and high pressure pump may be used to fracture a formation with a proppant slurry. The blender, also referred to as a blender unit, may include a mixing system for blending proppant, e.g., sand, and water with various additives, e.g., friction reducers, to produce the proppant slurry. The high pressure pumps, also referred to as fracturing units, may deliver the proppant slurry into the wellbore with sufficient pressure to fracture the formation and deposit the proppant into the fractures.

The pumping equipment used at various well construction stages may include or be communicatively coupled to a unit controller. The unit controller may comprise a computer system with one or more processors, memory, input devices, and output devices. The unit controller may be programmable with one or more pumping procedures for the mixing and placement of wellbore treatments. The unit controller can be communicatively connected to various components of the pumping equipment including the mixing system and main pump. For example, the unit controller may be communicatively coupled to a mixing drum, a water pump, a plurality of valves, an additive system, a main pump, and a data acquisition system. The unit controller can establish control over the various components of the pumping equipment, e.g., the mixing system, with the data acquisition system providing feedback of the pumping operation. In some cases, the respective unit controllers associated with two or more pumping equipment assemblies may be communicatively connected so that the pumping equipment assemblies cooperatively work together. For example, the blender and one or more high pressure pumps may cooperatively deliver proppant slurry to the wellbore.

The delivery of the wellbore treatment, e.g., a cement slurry, from the pumping equipment at a desired flowrate can depend upon the health of the mixing system, the main pump, control valves, and various components. The health of the pumping equipment may decline based on the accumulated volume of treatments mixed, the amount of time in operation, and/or the number of jobs performed. For example, the various components of the mixing system may encounter wear and general degradation of operating ability during normal operation from sequential jobs. Service personnel can perform diagnostic tests on the pumping equipment, e.g., the mixing system, before or after a job, however, in some cases the diagnostic tests can be inconclusive and/or service personnel may not recognize data indicative of present or forthcoming problems. Additionally or alternatively, the service personnel may fail to record or submit the diagnostic test results for evaluation. As such, an improved method of determining the health status of the pumping equipment is needed.

One solution to the problem of the determining the status of the pumping equipment can comprise a process for automatically determining the health status of the pumping equipment executing within the unit controller. The automatic process can comprise multiple diagnostic methods, e.g., a diagnostic tests, on the various pumping equipment, e.g., mixing system, by configuring the various systems of the pumping unit to perform a predetermined routine while automatically logging the results. In an embodiment, the automatic process can query the pumps, valves, and sensors to determine a status. For example, the automatic process can determine if a flowrate sensor is communicatively connected to the unit controller. In an embodiment, the automatic process can configure one or more pumping equipment components to establish perform a diagnostic test on at least one pumping equipment component. For example, the automatic process may configure a piping network within the pump unit including setting at least one valve position through the mixing system, operating a pump such that a fluid is communicated through the piping network at one or more predetermined flowrates, and recording data from sensors during communication of the fluid. In an embodiment, the automatic process can configure one or more pumping equipment components to perform a diagnostic test on the pressure manifold and the main pump. For example, the automatic process may isolate the pressure manifold from the mixing system to pressure test the pressure manifold and record data from sensors during the application of pressure. The data from the sensors can be logged into a data storage location on the unit controller and, optionally, displayed on Human Machine Interface (HMI), e.g., a display. The data can comprise pump speed value, valve position value, flowrate data, pressure data, or combinations thereof. The data may be subjected to processing to yield results indicative of the health status of the pumping equipment. For example, the results may indicate that the pumping equipment is operating nominally, that the mixing system, or a component thereof, needs maintenance, that the flowrate of a supply pump is below an operating threshold, that the pressure manifold cannot obtain the needed operating pressure and should be taken out of service, or combinations thereof. The results may be displayed as a curve, a table, or a simple pass or fail, e.g., pass/fail status, an error or warning message, or combinations thereof.

Additionally or alternatively, in an embodiment the unit controller can cause the data and/or results to be wirelessly communicated between the system and a remote location, for example, a remote service center. For example, in an embodiment, the unit controller may comprise or be communicatively coupled to a wireless communication assembly capable of wireless communication with the remote service center, such as through a mobile network. In some embodiments, the data can be transmitted to the remote service center for processing to yield the results indicative of the health of the mixing system. Additionally or alternatively, in some embodiments the results of the flowrate test can be transmitted to the remote location, for example, a data storage location and/or the remote service center, for recordation. The unit controller may automatically report the health status of the mixing system at the end of the test.

In some embodiments, the unit controller can compare the diagnostic test results to a set of operational parameters to determine if maintenance is required. A monitoring process executing on the unit controller can determine if maintenance is needed on one or more portions of the pumping equipment for a pumping operation. In some embodiments, a monitoring process can track the type and duration of wellbore treatments the pumping unit performs. The diagnostic process can compare the diagnostic test results to a log of well treatment pumping operations and a log of the type and occurrence of maintenance performed on the pumping equipment. In some embodiments, the unit controller can determine when maintenance is recommended or required based on a predictive model. The predictive model can be based on a historical database of pumping operations. The unit controller can alert the field personnel via the interactive display when maintenance is recommended for pumping equipment. The alert from the monitoring application can alert the remote service center of the type of maintenance required. The remote service center can place the pumping unit on a service schedule. In some embodiments, the remote service center can prompt the unit controller to perform additional diagnostic tests.

Disclosed herein is a method of automating the diagnostic testing of pumping equipment. An automated process can actuate and measure individual components of the pumping equipment. The automated process can configure a piping network to perform diagnostic testing of one or more portions of the pumping equipment while recording datasets from sensors distributed about the network. The automated process can compare the dataset log to one or more operational parameters to determine a health status of the pumping equipment. The dataset can be transmitted to a service center. A monitoring application can provide a prediction of pumping equipment maintenance based on diagnostic testing and past pumping equipment utilization. The method of automating the diagnostic testing of pumping equipment can increase the reliability of the pumping unit.

FIG. 1 illustrates a wellsite environment 10, according to one or more aspects of the presently-disclosed subject matter. The wellsite environment 10 comprises a drilling or servicing rig 12 that extends over and around a wellbore 16 that penetrates a subterranean formation 18 for the purpose of recovering hydrocarbons. The wellbore 16 can be drilled into the subterranean formation 18 using any suitable drilling technique. While shown as extending vertically from the surface 14 in FIG. 1, the wellbore 16 can also be deviated, horizontal and/or curved over at least some portions of the wellbore 16. For example, the wellbore 16, or a lateral wellbore portion of the wellbore 16, can have a vertical portion 20, a deviated portion 22, and a horizontal portion 24. Portions or all of the wellbore 16 can be cased, open hole, or combination thereof. For example, a first portion extending from the surface can contain a string of casing 26 and a second portion can be a wellbore drilled into a subterranean formation 28. A primary casing string 26 can be placed in the wellbore 16 and secured at least in part by cement 30.

The servicing rig 12 can be one of a drilling rig, a completion rig, a workover rig, or other structure and supports operations in the wellbore 16. The servicing rig 12 can also comprise a derrick, or other lifting means, with a rig floor 32 through which the wellbore 16 extends downward from the servicing rig 12. In some cases, such as in an off-shore location, the servicing rig 12 can be supported by piers extending downwards to a seabed. Alternatively, the servicing rig 12 can be supported by columns sitting on hulls and/or pontoons that are ballasted below the water surface, which can be referred to as a semi-submersible platform or floating rig. In an off-shore location, a casing can extend from the servicing rig 12 to exclude sea water and contain drilling fluid returns.

In an embodiment, the wellbore 16 can be completed with a cementing process by way of which a cement 30 is disposed in an annular space 40 between the casing string 26 and the wellbore 16. A pump unit 34, also called cement pumping equipment, can be fluidically connected to a wellhead 36 by a supply line 38. The wellhead 36 can be any type of pressure containment equipment connected to the top of the casing string 26, such as a surface tree, production tree, subsea tree, lubricator connector, blowout preventer, or combination thereof. The wellhead 36 can anchor the casing string 26 at surface 14. The wellhead 36 can include one or more valves to direct the fluid flow from the wellbore and one or more sensors that gather pressure, temperature, and/or flowrate data. In operation the pump unit 34 can pump a volume of cementitious slurry, which may be specifically tailored to the wellbore, though the supply line 38, through the wellhead 36, down the casing string 26, and into the annular space 40.

The cement 30 can be Portland cement or a blend of Portland cement with various additives to tailor the cement for the wellbore environment. For example, retarders or accelerators can be added to the cementitious slurry to slow down or speed up the curing process. In some embodiments, the cement 30 can include a polymer designed for high temperatures. In some embodiments, the cementitious slurry can include additives such as fly ash to change the density, e.g., decrease the density, of the cementitious slurry.

The pump unit 34, also referred to as a wellbore pump unit, may include mixing equipment 44, pumping equipment 46, and a unit controller 48. The mixing equipment 44 can be in the form of a jet mixer, recirculating mixer, a batch mixer, a single tub mixer, or a dual tub mixer with a mixing device and a liquid delivery system. The mixing equipment 44 can combine a dry ingredient, e.g., cement, with a liquid, e.g., water, for pumping via the pumping equipment 46 into the wellbore 16. The liquid delivery system comprises a supply pump, a flow control valve, and sensors. The pumping equipment 46 can be a centrifugal pump, piston pump, or a plunger pump. The unit controller 48 may establish control of the operation of the mixing equipment 44 and the pumping equipment 46. The unit controller 48 can operate the mixing equipment 44 and the pumping equipment 46 via one or more commands received from the service personnel as will be described further herein. Although the pump unit 34 is illustrated as a truck, it is understood that the pump unit 34 may be skid mounted or trailer mounted. Although the pump unit 34 is illustrated as a single unit, it is understood that there may be 2, 3, 4, or any number of pump units 34 fluidically coupled to the wellhead 36, for example, via a fluid manifold.

Although the embodiment of FIG. 1 describes the wellsite environment 10 in the context of a cementing operation, in an additional or alternative embodiment, for example, in the context of a drilling or completion operation, a pump unit similarly-situated to the pump unit 34 of FIG. 1 can be a mud pump fluidically connected to the wellbore 16 by the supply line 38 to pump drilling mud slurry or a water based fluid such as a completion fluid, e.g., a completion brine, into the wellbore 16. Mixing equipment 44 may similarly be employed to blend or mix a dry mud blend with a fluid such as water or oil-based fluid. The pumping equipment 46 may include a piston pump or other suitable type or configuration. The drilling mud slurry or the completion brine may be referred to as a wellbore treatment.

In an alternate embodiment, for example, in the context of a completion operation, a pump unit similarly situated to the pump unit 34 of FIG. 1 can be a blender fluidically connected to one or more high pressure pumping units, also called "frac" pumps, that are fluidically connected to the wellbore 16 by the supply line 38 to pump a wellbore treatment, e.g., frac slurry, into the wellbore 16. Mixing equipment like the mixing equipment 44 of FIG. 1 may similarly be employed to blend or mix a proppant, e.g., sand, with a water mixture that includes one or more additives, e.g., a friction reducer or a gel, into the frac slurry. The pumping equipment 46 may be a centrifugal pump or a plunger pump. Although one pump unit 34 is illustrated in FIG. 1, it is understood that two or more pump units may be coupled to the wellbore 16 and communicatively coupled by the unit controller 48 to cooperatively pump a wellbore treatment into the wellbore 16. For example, a blender may be fluidically coupled to wellhead 36 via a frac pump. The blender and the frac pump may be communicatively coupled by the unit controller 48.

Referring to FIG. 2, a particular embodiment of the pump unit 34 is illustrated in further detail as pump unit 200. In the embodiment of FIG. 2, the pump unit 200 comprises a supply tank 202, a mixing system 220, a main pump 206, and at least one power supply 208. The main pump 206 can be a centrifugal pump or a plunger pump. The power supply 208 can include one or more electric-, gas-, or diesel-powered motors which are coupled to the supply tank 202, the mixing system 220, the main pump 206, and the various components such as feed pumps and valves. The power supply 208 may supply power to actuate the main pump 206. For example, the power supply 208 can be directly coupled by a drive shaft or indirectly coupled, such as via an electrical power supply, to the main pump 206. The mixing system 220 can blend a fluid composition of water, dry ingredients, e.g., cement, mud, or sand, and other additives for delivery to the wellbore 16 via the main pump 206.

The pump unit 200 may comprise a unit controller 240, a data acquisition system (DAQ) card 242, and a display 244. The unit controller 240 may comprise a computer system comprising one or more processors, memory, input devices, and/or output devices with one or more processes executing in memory and configured to carry out one or more of the methods or protocols disclosed herein, or a portion thereof. The unit controller 240 may be communicatively connected to the pumping equipment and mixing equipment of the pump unit 34. The DAQ card 242 may convert one or more analog and/or digital signals into signal data. In various embodiments, the DAQ card 242 may be a standalone system with a microprocessor, memory, and one or more applications executing in memory, or may be combined or incorporated with the unit controller 240 into a unitary assembly. For example, the DAQ card 242 may be combined with one of the input output devices of the unit controller 240 when combined into a unitary assembly. The display 244, e.g., interactive display, may be a suitable configuration of Human Machine Interface (HMI) that provides an input device and an output device for the unit controller 240. Additional or alternative devices may also be used. The display 244 may include a selectable input screen that includes icons and selectable key board or key pad inputs for the unit controller 240. The display 244 may display data and information about the status and operation of the pump unit 200 to a user, including data from the DAQ card 242.

The supply tank 202 can store a volume of water or other liquid and provide the water or liquid for use in the mixing system 220. The supply tank 202 can be connected to a water supply unit, e.g., water tank, by a supply line 212, a supply pump 214, and a sensor valve 216. The supply pump 214 can comprise a centrifugal pump, a piston pump, or a plunger pump. The sensor valve 216 can comprise a flow control valve, e.g., a globe valve, a pinch valve, or a needle valve, that can be open, closed, or regulate the fluid flow within. The unit controller 240 may provide power, e.g., voltage and current, and/or a control signal to the sensor valve 216 and the supply pump 214. The supply tank 202 may have one or more sensors, e.g., a tub level sensor, communicatively connected to the unit controller 240 via the DAQ card 242.

Figure 2A:
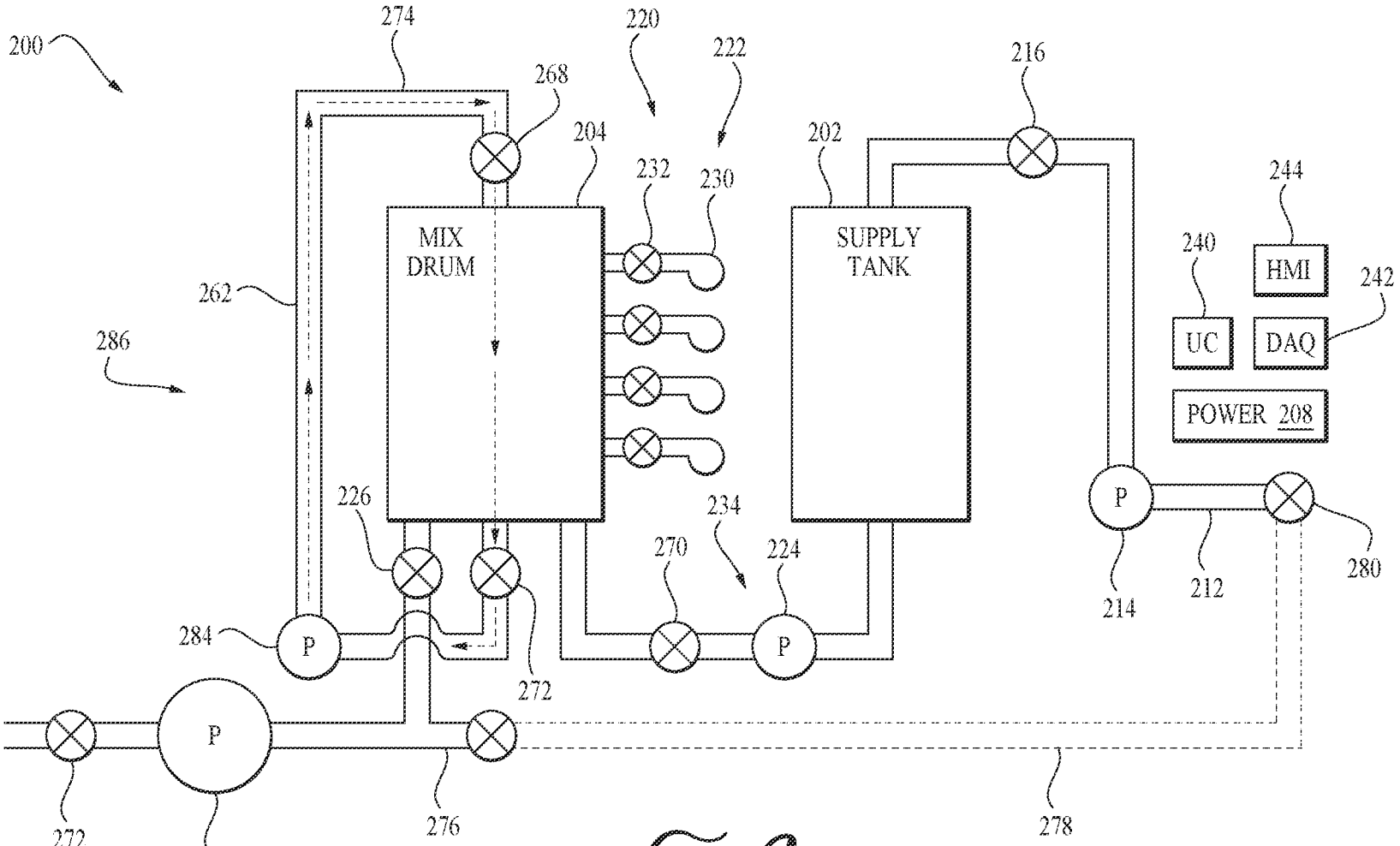
FIG. 2A is an illustration of a pump unit assembly according to an embodiment of the disclosure.
Figure 2B:
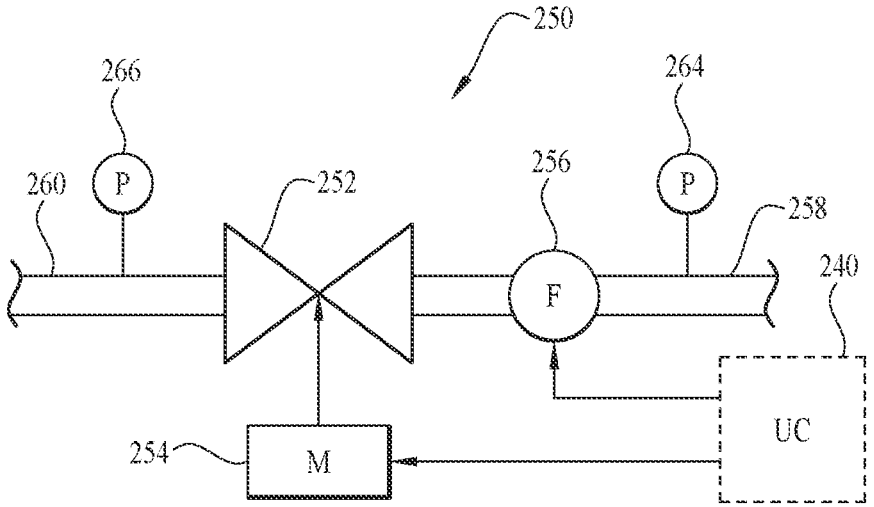
FIG. 2B is an illustration of a sensor valve with control and monitoring components subject to diagnostic testing according to an embodiment of the disclosure.

A supply valve, e.g., sensor valve 216, may be one part of a sensor valve assembly. Turning now to FIG. 2B, an example of a sensor valve assembly 250 may be illustrated. In some embodiments, the sensor valve assembly 250 comprises a flow valve 252, a valve actuator 254, a flowrate sensor 256, an inlet 258, and an outlet 260. The flow valve 252 can be a globe valve, a pinch valve, a needle valve, a plug valve, or a slide valve. The valve actuator 254 may be mechanically coupled to the flow valve 252, e.g., a throttling valve, and communicatively coupled to the unit controller 240. The positional sensors on the valve actuator 254 can provide feedback, e.g., positional feedback, to the unit controller 140 via the DAQ 142. In some embodiments, the sensor valve assembly 250 can have one or more sensors communicatively connected to the unit controller 140 including one or more pressure sensors, a flow rate sensor, or combination thereof. For example, a flowrate sensor 256 may be communicatively connected to the unit controller 140 via the DAQ 242. The sensor valve assembly 250 can comprise an upstream pressure sensor 264, a downstream pressure sensor 266, or both. The upstream pressure sensor 264 can be located along the inlet 258 and the downstream pressure sensor 266 can be located along the outlet 260 of the flow control valve 150. The sensor valve 216 can be an embodiment of the sensor valve assembly 250.

The sensors can provide feedback of the status and operation of the valve to the unit controller 240. For example, the unit controller 240 can open the flow valve 252 with the valve actuator 154 to a desired position of 0%, 25%, 50%, 100% or any position between 0 to 100%. The sensors can provide pressure and/or flowrate measurements corresponding to the fluid flow, e.g., water flow, through the flow valve 252 at a given position. The flowrate sensor 256 may be a turbine type flow meter or a Coriolis type flow meter. The flowrate sensor 256 may transmit periodic datasets, e.g., measurements of flow rate, of the volumetric flow rate of fluid through the sensor valve 216 to the unit controller 240 via the IRAQ card 242.

In some embodiments, the sensor valve assembly can comprise a valve, a valve actuator, and valve positional sensors. For example, the sensor valve assembly may be referred to as an isolation valve with an on or off position or a directional valve that changes the fluid flowpath from a first fin path to a second flowpath. In some embodiments, the sensor valve assembly can comprise a valve a valve actuator with positional sensors, and at least one pressure sensor. For example, the sensor valve assembly may comprise a throttling valve that can choke the flow as the valve closes. In some embodiments, the sensor valve assembly can comprise a flow control valve, a valve actuator with positional sensors, at least one pressure sensor, and a flow control valve. For example, the sensor valve assembly can tune the flowrate and/or pressure drop through the flow control valve with the feedback from the sensors. The term valve assembly can refer to a valve, a valve actuator, one or more valve positional sensors, one or more pressure sensors, a flow control valve, or combinations thereof.

The mixing system 220 can include a mixing drum 204, one or more additive systems 222, and a liquid delivery system 234. The liquid delivery system can fluidically connect the supply tank 202 to the mixing drum 204. The one or more additive systems 222 may fluidically connect a volume of liquid additives, such as accelerators, retarders, extenders, fluid loss, and viscosity modifiers, to the mix drum 204. The additive systems 222 can comprise an additive pump 230, an additive valve 232, a flow meter, a volume measurement device, or combinations thereof. The additive pump 230 can be a diaphragm pump, a piston pump, or a centrifugal pump. The additive valve 232 can be an on-off valve such as a ball valve or plug valve. Each additive pump 230 can be communicatively coupled to a corresponding flow meter and to the unit controller 240 via the DAQ card 242. The unit controller 240 can dispense a predetermined volume of additive by controlling the additive pump 230 and additive valve 232 with feedback from the flow meter. The liquid delivery system 234 comprises a supply pump 224 and a sensor valve assembly 270, e.g., a flow control valve. The liquid delivery system 234 can supply a predetermined flowrate of liquid, e.g., water, to the mix drum 204. The unit controller 240 may change the volumetric rate of the liquid, e.g., water, ater, with the supply pump 224 and the valve position of the sensor valve 270 in response to the data from one or more sensors, e.g., flow meter. The mixing system 220 can include a mix valve 226, e.g., a sensor valve, located between the mixing drum 204 and main pump 206 referred to as a mix valve 226. The mix valve 226, e.g., a sensor valve, can be a flow control valve or an isolation valve, e.g., a ball valve or plug valve. In some embodiments, the liquid delivery system 234 can supply water via supply pump 214 and supply line 212. The sensor valve 270 can be an embodiment of the sensor valve assembly 250.

In some embodiments, the mixing system 220 comprises a flow loop 274. The flow loop 274 can comprise a first sensor valve 272, a mix pump 284, a return line 262, and a second sensor valve 268. The unit controller 240 can configure the flow loop 274 by opening the first sensor valve 272 and second sensor valve 268 to fluidically connect the return line 262 to the mix drum 204. The mix pump 284, e.g., supply pump, and at least one valve, e.g., sensor valve 272, can be configured by the unit controller 240 to supply the desired fluid flowrate through the flow loop 274. The sensor valve 272 can be an embodiment of the sensor valve assembly 250.

In some embodiments a return line 278 can fluidically connect the mixing drum 204 to the supply line 212. For example, the unit controller 240 configure a flow path to the supply line 212 via the return line 278 with a third sensor valve 276 and a fourth sensor valve 218. In some embodiments, the return line 278 can be a portion of the fluid manifold of the pump unit 200, for example, a high pressure line permanently installed. In some embodiments, the return line 278 can be a temporary line, e.g., a flexible hose, installed by the service personnel. The return line 278 can provide a flow path to return or loop the fluid flow through the pump unit 200.

Figure 3:
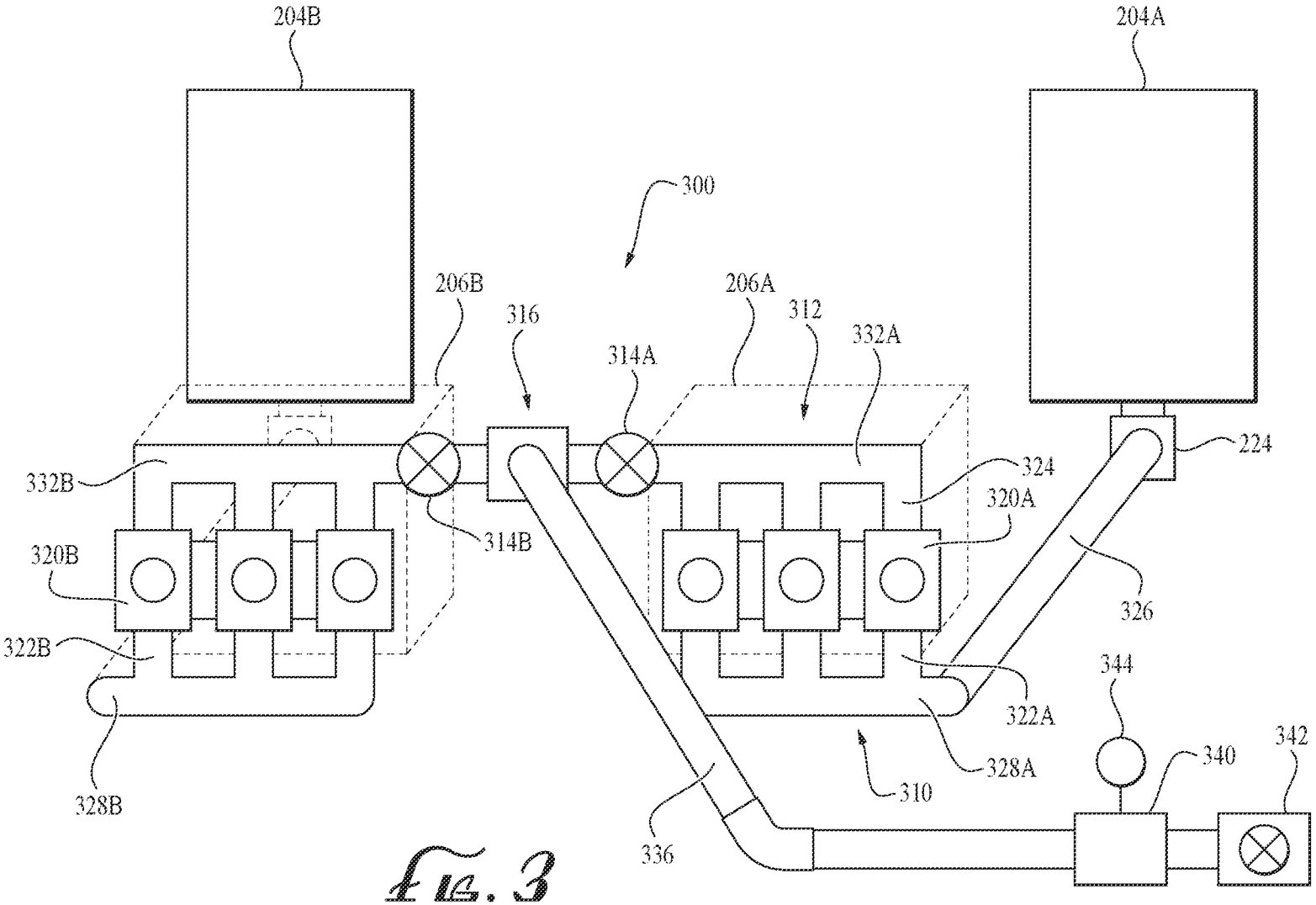
FIG. 3 is an Illustration of a fluid end and pressure manifold according to an embodiment of the disclosure.
Figure 4:
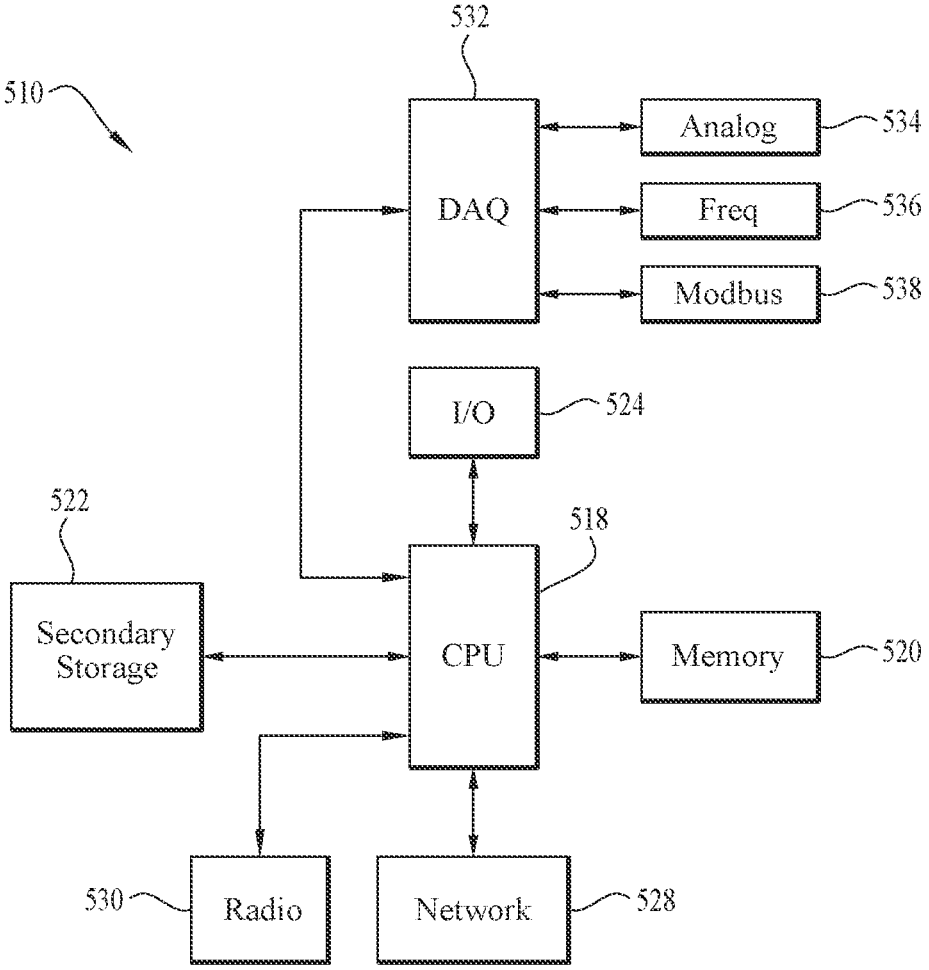
FIG. 4 is a block diagram of a unit controller according to an embodiment of the disclosure.

The main pump 206 may be configured according to the operation in which it will be employed. For example, the main pump 206 may be a centrifugal pump, a piston pump, or a plunger pump. For example, in the context of a cementing operation, the main pump 206 can be a centrifugal pump. In another scenario, the cementing operation can utilize a high pressure pump, e.g. a plunger pump, for the main pump 206. The slurry mixed within the mixing drum 204 can be transferred to the main pump 206 via an intake manifold to be pressurized and the main pump can deliver the treatment fluid through a discharge manifold. Turning now to FIG. 3, an illustration of pressure manifold 300 of the pump unit 200 is described. In some embodiments, the pressure manifold 300 can comprise an intake manifold 310, an discharge manifold 312, a sensor valve 314, and a discharge hub 316. The intake manifold comprises a high pressure line 326, an intake header 328, and an intake line 322 coupled to a fluid end 320 of the main pump 206. The fluid end 320 of the main pump 206 typically has three plungers, thus there can be three intake lines, e.g. intake lines 322A-C, coupled to the intake header 328. Similarly, the discharge manifold 312 comprises three discharge lines 324A-C coupled to a discharge header 332. The discharge manifold 312 can be coupled to the sensor valve 314 and discharge hub 316. The sensor valve can be communicatively coupled to the unit controller 240.

The intake manifold 310 can be fluidically connected to the mixing drum 204 via high pressure line 326 and mix valve 226. The intake manifold 310 can receive wellbore treatment fluid, e.g., cement slurry, from the mix drum 204 and distribute the fluid to each plunger/pressure chamber within the fluid end 320 of the main pump 206.

The discharge manifold 312 can receive the pressurized fluid from the fluid end 320 via the discharge lines 324A-C and discharge header 332. The pressurized fluid can travel through the discharge hub 316 to a high pressure line 336. In some embodiments, the high pressure line can be coupled to a wellhead. Referring back to FIG. 1, the pumping equipment 46 of pump unit 34 can deliver pressurized fluid to the wellhead 36 via supply line 38. As illustrated in FIG. 3, the high pressure line 336 can be coupled to a test block 340 and a sensor valve 342. The test block 340 can include a pressure transducer 344 communicatively coupled to the unit controller 240 for testing the pressure manifold 300 as will be described herein after. The sensor valve 342 can be communicatively connected to the unit controller 240. In some embodiments, the sensor valve 342 may be an isolation valve with or without a pressure sensor.

As illustrated in FIG. 3, the pump unit 200 can be a dual pump unit comprising two mix systems 220A-B, two supply tanks 202A-B, two mix drums 204A-B, and two main pumps 206A-B. The operation of the mix system 220A can be independent of mix system 220B and thus the mix drum 204A can operate independently of mix drum 204B. The pressure manifold 300 can be configured to output only the servicing fluid from mix system 220A or servicing fluid from mix system 220B with the operation of the sensor valves 314A and 314B. For example, the sensor valve 314B can be closed and sensor valve 314A can be opened to direct the output of mix drum 204A via the main pump 206A through the discharge hub 316 for delivery to the wellhead via the high pressure line 336. The pressure manifold 300 can be configured with both sensor valves open to combine the main pump 206A output with the main pump 206B output at the discharge hub 316 for delivery to the wellhead, e.g., wellhead 36, via the high pressure line 336.

Although the pump unit 200 of FIG. 2 is described as a cement pumping unit with a supply tank 202 (also referred to as a clean side) and a mixing drum (also referred to as a dirty side), the pump unit 200 can be configured as a dual mixing tub blender and/or cementing unit. As a dual mixing tub blender, the mixing system 220 can be doubled by replacing the supply tank 202 with a second mix drum 204B, a second flow loop 274B, and a second additive system 222B. The dual tub blender can mix or blend two volumes of wellbore treatment simultaneously or blend a portion of a treatment in one mixing tank for transfer to the second mixing tank for blending additional materials into the treatment fluid. In some embodiments, the pump unit 200 can be a dual pump unit with dual mixing tub blenders with a total of four mixing drums or two mixing systems 200A-B with four mixing tanks 204A-D.

Although the pump unit 200 of FIG. 2 is described as a cement pumping unit, it is understood that the pump unit 200 may be a mud pump, a blender, a frac pump, or a water supply unit. Each type or configuration of pump unit, e.g., a mud pump, a cement pump unit, a blender, a frac pump, or a water supply, may include a main pump, e.g., main pump 206, a sensor valve, e.g., sensor valve 270, and a unit controller, e.g., unit controller 240. The unit controller, e.g., unit controller 240, can receive periodic pumping data and can be communicatively connected to one or more main pumps 206. In some embodiments, the pump unit, e.g., pump unit 200, may work in concert with at least one ore pump unit. In some embodiments, the pump unit 200 may be communicatively connected to and controlled by a control system at the wellsite.

In some embodiments, a wellbore servicing method may include providing a wellbore treatment, via a pump unit, following a prescribed pumping procedure for the placement of the wellbore treatment at a target location within the wellbore. The wellbore treatment placed in the performance of the pumping procedure can include a treatment blend, e.g., cement blend, a liquid blend, e.g., water with additives, or combinations thereof and may be placed via one or more downhole tools.

In an embodiment, the wellbore servicing method may comprise transporting the pump unit, e.g., 34 of FIG. 1, to the wellsite environment 10. The pump unit 34 may be positioned at the wellsite environment 10 and the service personnel may prepare the pumping unit for a pumping operation. Before coupling the pumping unit 34 to the wellhead 36, the service personnel may initiate an automated diagnostic process via the unit controller 48. In some embodiments, the unit controller 48 may initiate the automated diagnostic process as part of the startup process.

In some embodiments, a diagnostic test to determine the health status of the pumping equipment may be initiated prior to a wellbore servicing operation, at the completion of a wellbore servicing operation, at the prompting of a service center, or combinations thereof. For example, the diagnostic test may be included in a startup procedure for the pumping unit 34. When the diagnostic test is to be performed, the unit controller 48 may automatically initiate the diagnostic test or may prompt a user, e.g., service personnel, to initiate the diagnostic test. In an embodiment, the pumping unit 34 may be prohibited from completing a startup or shutdown procedure where the diagnostic test is not completed, for example, such that the pumping unit 34 cannot be used in the performance of a wellbore servicing operation until the diagnostic test is completed.

In some embodiments, the results of the diagnostic test can be outputted, for example, as an alert provided to the service personnel, for example, a pass/fail indicia, a text message, or combination. For example, in an embodiment, the service personnel may be notified of a "fail" status, which may be the result of the diagnostic test. Additionally or alternatively, the fail status may be the result of a missing system performance file including the results of the diagnostic test, a corrupted system performance file, or a system performance file that cannot be accessed. In various embodiments, the alert provided to the service personnel may be generated by the unit controller 240, a remote computer, e.g., executing on a network location, or a combination thereof as will be disclosed further hereinafter. Additionally or alternatively, the results of the diagnostic test may form the basis for an action. For example, where a pumping unit 200 has been assigned a fail status, the unit controller 240 may prohibit operation of the pumping unit 200 until the diagnostic test has been performed and the pumping unit 200 is assigned a pass status, until the pumping unit is serviced, or the like.

Figure 5A:
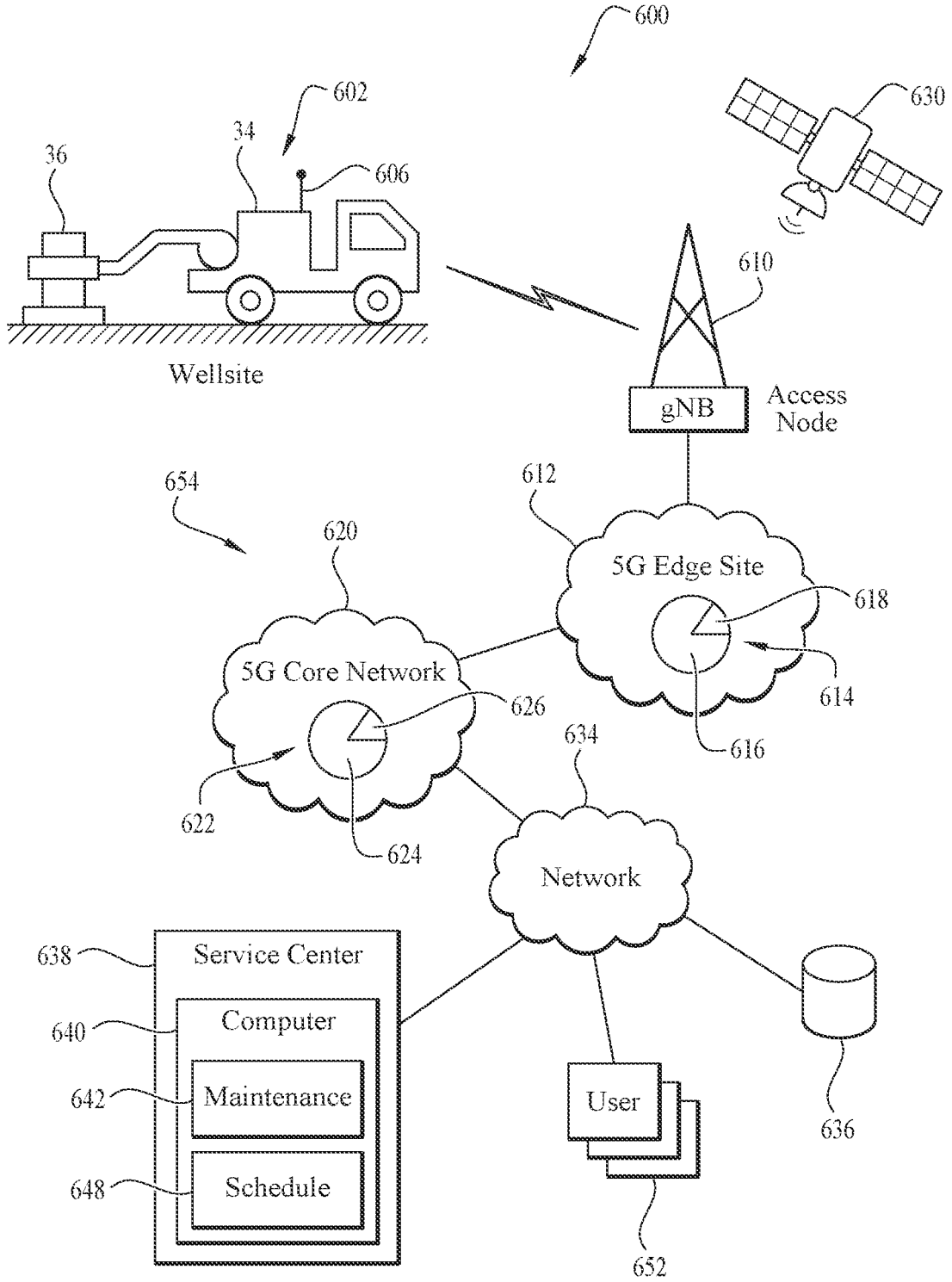
FIG. 5A is an illustration of a communication system according to an embodiment of the disclosure.
Figure 5B:
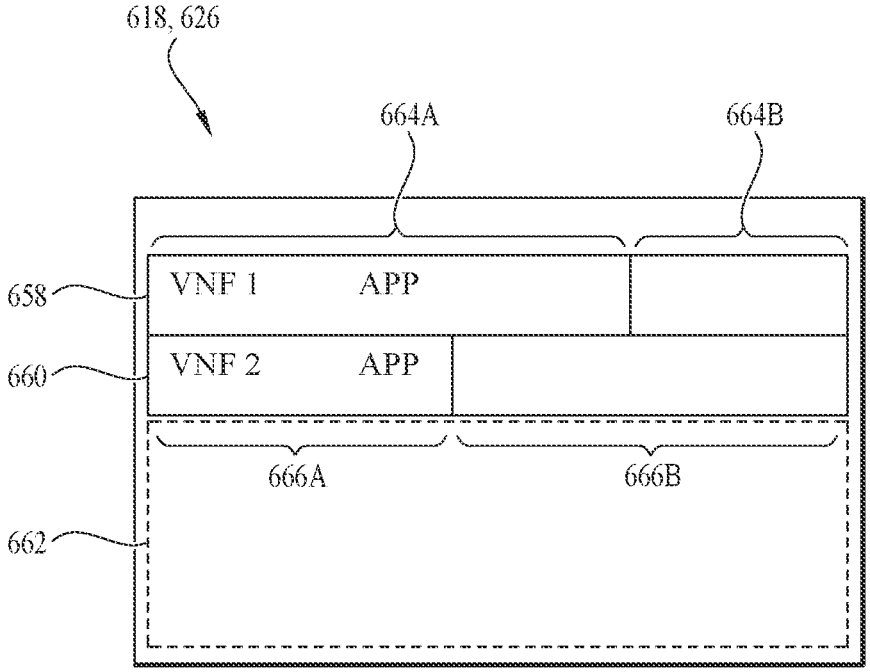
FIG. 5B is a block diagram of an application within a virtual network function on a network slice according to an embodiment of the disclosure.

An automatic process may comprise multiple diagnostic methods to determine the health of the pumping equipment of a pumping unit, e.g., pumping unit 200. In some embodiments, the automatic process may perform multiple diagnostic methods in a predetermined sequence. For example, a first diagnostic method, e.g., diagnostic test, can be followed by a second diagnostic method and a third diagnostic method. The later diagnostic methods may include components tested during the earlier diagnostic methods. For example, a third diagnostic method, e.g., diagnostic test, may include components, e.g., valves, that were tested during the first and second diagnostic method. In some embodiments, the automatic process executing on the unit controller 240 can query the status of the communication devices. Turning to FIG. 5, the automatic process can perform a readiness diagnostic method to determine an operational status of the connected components of the pumping equipment. The operational status can comprise a communication status, an operation status, and a calibration status. The readiness diagnostic method of the automatic process can query a network device 588 and a long range radio transceiver 590 to determine if the unit controller 240 is communicatively connected to a network, e.g., a local area network, and/or a wireless communication network. The unit controller 240 can be communicatively connected to a user device, e.g., a laptop, a second pumping unit, a control van directing a plurality of pumping units, a computer system at a service center, a process at a remote location, a computer system at a remote location, a network location, or combinations thereof. The readiness diagnostic method can return a fault for the communication status if the readiness diagnostic method can't communicate with the network device 588 and/or the radio device 590. The readiness diagnostic method can return a fault for the operation status if the network device 588 and/or the transceiver 590 can't communicatively connect to the local area network or the wireless communication network.

In some embodiments, the automatic process executing on the unit controller can query the status of the various components of the pumping equipment via the DAQ 242. The automatic process can perform a readiness diagnostic method to determine an operational status of the connected components of the pumping equipment. The operational status can comprise a communication status, an operation status, and a calibration status. The readiness diagnostic method of the automatic process can query the device communicatively coupled to an analog input 594, a frequency input 596, and a Modbus input 598. For example, the readiness diagnostic method can query a tank level sensor on the mix drum 204 and/or supply tank 202 via the analog input 594. In another scenario, the diagnostic method can query the plurality of flow meters, e.g., sensor valve 272 or sensor valve 270, via the frequency input 596. In still another scenario, the diagnostic method can query the valve actuators 254 and/or positional sensors via the Modbus input 198. The readiness diagnostic method can return a fault for the communication status if the diagnostic method can't communicate with the sensor, e.g., valve sensor 272. The readiness diagnostic method can actuate the various components of the pumping equipment to determine an operational status. For example, the readiness diagnostic method can actuate a valve from a first position to a second position, e.g., from 100% open position to 0% open position. The readiness diagnostic method can return a fault for operation status if the datasets from the valve positional sensors are outside of the expected or operational datasets. Some components of the pumping equipment can access a calibration file during non al operation. For example, each flow meter may have a calibration dataset based on fluid flow. In another example, the valve position sensors may have a calibration dataset that associates an angular valve position, e.g., 3 degrees, with a valve operational position, e.g., 0% open or closed position. The readiness diagnostic method can return a fault if a calibration file is not found, is corrupted, or is flagged as a fault. The readiness diagnostic can return a success or a fault for the operational status of each of the components of the pumping equipment. In some embodiments, the readiness diagnostic can log the operational status into a file in memory 520 and/or secondary storage 522. In some embodiments, the operational status can be communicated to a remote location, e.g., a storage computer, via transceiver 590 and/or network device 588. The readiness diagnostic can provide an indicia of the operational status of the various components of the pumping equipment to the service personnel via text, messaging, email alerts, display 244, or combinations thereof. The pass or fail results of the readiness diagnostic can be referred to as a readiness check.

In some embodiments, the readiness diagnostic method can be performed during a second or subsequent diagnostic method performed by the automatic process. In some embodiments, the automatic diagnostic method can perform a liquid supply diagnostic to determine an operational status of the liquid delivery system 234. The liquid supply diagnostic can determine the operational status of the supply pump 214, the supply pump 224, and the sensor valve 270 by circulating water through one or both supply pumps. The liquid supply diagnostic can establish a first flow path through the piping network within the pumping unit 200 to deliver a flow of water from the supply tank 202, through the sensor valve 270, and return the water to the supply tank 202 by setting the valves e.g., positioning a plurality of valves to either an open or dosed position. For example, the liquid supply diagnostic can open, e.g., 100% open position, the sensor valves 216, 270, 226, and 276, while dosing sensor valves 272 and 268. This configuration of sensor valves can be referred to as the first flow path position. The piping network can be configured to circulate water through the supply pump 214, the sensor valve 216, the supply tank 202, the sensor valve 270, the mix drum 204, flexible valve 226, the sensor valve 276, the return line 278 and back to the supply pump 214. In some embodiments, the service personnel may need to connect a temporary line, e.g., flexible line for return line 278. The liquid supply diagnostic can operate the supply pump 214 to fill the supply tank 202 and mix drum 204 with a volume of water from the supply line 212. In some embodiments, the liquid supply diagnostic may prompt the service personnel to supply the water via operating the supply pump 214. The tank level sensors on the supply tank 202 can provide feedback to the unit controller 240 of the volume of water delivered by the supply pump 214. In some embodiments, the readiness diagnostic method can be operational during or in coordination with the liquid supply diagnostic filling the pump unit 200 with water. For example, the readiness diagnostic method can query the supply pump 214 at the beginning of the filling process. In another scenario, the readiness diagnostic method can query the valves before and/or during the actuation to establish the piping network. The liquid supply diagnostic may actuate one or more valves at the end of the filling process to establish a piping network that returns the volume of water flowing through the network to the supply tank, for example, sensor valve 280. The liquid supply diagnostic can perform a diagnostic test on the health of the liquid delivery system 234 with the pump unit 200 supplied with a volume of water.

As used herein, the term "health," when used with reference to the supply pump 214, the supply pump 224, the mix pump 284, the main pump 206, or the plurality of sensor valves may refer to the ability of the pumping equipment to transfer a liquid to the mixing drum 204 for blending of the wellbore treatment and/or delivery to the wellhead in accordance with a specified operational capacity. The operational capacity of the pumping equipment can be described as the fluid output, e.g., pressure and flowrate, from the supply tank 202, to the mix drum 204, to the main pump 206, and the wellhead via the various supply pumps and sensor valves. In an embodiment, the determination of the health of the mixing system 220 can comprise a determination that the mixing system 220 attains an operational capacity in accordance with the needs of a current or anticipated pumping operation and/or a determination that the mixing system 220 attains at least a minimum operational capacity. In an embodiment, the determination of the health of the supply pump 224 can comprise a determination that the supply pump 224 attains an operational capacity in accordance with the needs of a current or anticipated pumping operation and/or a determination that the supply pump 224 attains at least a minimum operational capacity. In an embodiment, the determination of the health of the mixing system 220 can comprise a determination that the mix pump 284 attains an operational capacity in accordance with the needs of a current or anticipated pumping operation and/or a determination that the mixing pump 284 attains at least a minimum operational capacity. In an embodiment, the determination of the health of the main pump 206 can comprise a determination that the main pump 206 attains an operational capacity in accordance with the needs of a current or anticipated pumping operation and/or a determination that the main pump 206 attains at least a minimum operational capacity.

In some embodiments, the liquid supply diagnostic can perform a diagnostic test on the health of the liquid delivery system 234 by circulating a volume of water through the piping network as previously described. The liquid supply diagnostic can establish water circulating through the piping network at the maximum operational capacity, e.g., full speed or 100% RPM, of the supply pump 214 while bypassing supply pump 224 (bypass not shown). The liquid supply diagnostic can receive periodic datasets indicative of the pumping operation from sensors, for example, pressure and flowrate sensors at the sensor valve 216 and sensor valve 270. The liquid supply diagnostic can compare the pressure and flowrate of the water through the sensor valve 216 to a set of operational capacity thresholds. The liquid supply diagnostic can close a sensor valve 216 while operating supply pump 214 at maximum capacity to determine the maximum pressure output of the supply pump 214. The diagnostic process can compare the pressure output to a set of operational capacity thresholds. The periodic datasets and the comparison of datasets to the set of operational capacity thresholds can be i) saved to memory,) saved to secondary storage 522, iii) communicated via transceiver 590 and/or network device 588 to a remote location, iv) sent as an alert to the service personnel, v) provided as an indicia to the service personnel via display 244, or vi) combinations thereof.

In some embodiments, the liquid supply diagnostic can perform the previously described diagnostic test with supply pump 224 and sensor valve 270. The flow path through the piping network can bypass supply pump 214 by establishing a flow bypass (not shown) around the supply pump 214, The liquid supply diagnostic can establish water circulating through the piping network at the maximum operational capacity of the supply pump 224 while receiving periodic datasets indicative of the pumping operation from sensors located at the sensor valve 270 and various other locations, e.g., mix valve 226. The liquid supply diagnostic can close, e.g., 0% open, the sensor valve 270 with the supply pump 224 operating at maximum capacity to determine the maximum pressure output of the supply pump 224. The liquid supply diagnostic can compare the pressure and flowrate of the water through the sensor valve 216 and the maximum pressure output to a set of operational capacity thresholds. The periodic datasets and the comparison of datasets to the set of operational capacity thresholds can be i) saved to memory, i) saved to secondary storage 522, communicated via transceiver 590 and/or network device 588 to a remote location, iv) sent as an alert to the service personnel, v) provided as an indicia to the service personnel via display 244, or vi) combinations thereof.

In some embodiments, the liquid supply diagnostic can actuate one or more sensor valves to various valve positions while circulating water with the supply pump 224. For example, the liquid supply diagnostic may position a sensor valve at 25% open, 50% open, 75% open, and 100% while operating the supply pump 224 at maximum capacity and/or maximum revolutions per minute (RPM). In some embodiments, the liquid supply diagnostic can actuate the sensor valve 270 located between the supply tank 202 and mix drum 204 to various positions while receiving periodic datasets indicative of the pumping operation from the sensor valve 270. In some embodiments, the liquid supply diagnostic can actuate the mix valve 226 located between the mix drum 204 and the return line 278 to various positions while receiving periodic datasets indicative of the pumping operation from the mix valve 226, e.g. a sensor valve. The diagnostic process can compare the pressure and flowrate output of the sensors to a set of operational capacity thresholds. The periodic datasets and the comparison of datasets to the set of operational capacity thresholds can be i) saved to memory, ii) saved to secondary storage 522, iii) communicated via transceiver 590 and/or network device 588 to a remote location, iv) sent as an alert to the service personnel, v) provided as an indicia to the service personnel via display 244, or vi) combinations thereof.

Although the liquid supply diagnostic is described as actuating sensor valve 270 and mix valve 226, it is understood that the diagnostic process can perform the diagnostic procedure on any number of valves, for example, sensor valve 216.

In some embodiments, a mix water diagnostic process can perform a diagnostic test on the health of a mix water system 286 by circulating a volume of water through the flow loop 274. The diagnostic process can configure a plurality of valves to establish the flow loop 274 and isolate the flow loop 274 from the liquid delivery system 234. For example, the diagnostic process can close, e.g., set the valve to 0% open, the sensor valve 270 and the mix valve 226 and open, e.g., 100% open, the sensor valve 272 and the sensor valve 268. This configuration of a plurality of sensor valves can be referred to as the flow loop position. The mix water diagnostic can establish water circulating through the flow loop 274 at the maximum operational capacity of the mix pump 284. The mix water diagnostic process can receive periodic datasets indicative of the pumping operation from sensors, for example, pressure and flowrate sensors at the sensor valve 272 and sensor valve 268. The diagnostic process can compare the pressure and flowrate of the water through the sensor valve 272 and/or sensor valve 268 to a set of operational capacity thresholds. The liquid supply diagnostic can close sensor valve 268 while operating mix pump 284 at maximum capacity to determine the maximum pressure output of the mix pump 284. The diagnostic process can compare the pressure output to a set of operational capacity thresholds. The periodic datasets and the comparison of datasets to the set of operational capacity thresholds can be i) saved to memory, ii) saved to secondary storage 522, Hi) communicated via transceiver 590 and/or network device 588 to a remote location, iv) sent as an alert to the service personnel, v) provided as an indicia to the service personnel via display 244, or vi) combinations thereof.

In some embodiments, a method for determining a health status of the pumping equipment, e.g., the liquid delivery system or the mix water system, may generally include the steps of preparing the pumping equipment, e.g., the mixing system 220, for a diagnostic test, running the diagnostic test and collecting a plurality of periodic datasets, assessing the plurality of periodic datasets, and determining health of the pumping equipment based upon the results of assessing the dataset.

In some embodiments, the diagnostic process may prepare the various components of the pumping equipment for the diagnostic test by filling or otherwise providing fluid to the piping network. For example, the unit controller 240 may control the pumping unit 200 components to fill the piping network by placing a volume of water in the supply tank 202 and/or the mixing drum 204 via the supply line 212. For example, the unit controller 240 may open the sensor valve 216 and operate the supply pump 214 to fill the supply tank 202 and the mixing drum 204 until the tub level sensor in one or both locations indicates the supply tank 202 or mixing drum 204 is sufficiently filled with water. For example, the unit controller 240 may fill the supply tank 202 and mixing drum 204 until at least one tub level sensors indicates that one or both tanks are 40%, 45%, 50%, 55%, 60%, or any portion of water level between 15% and 100% of the filled capacity of the tubs. The unit controller 240 may stop the supply pump 214 and configure one or move valves such that the pumping unit is configured as illustrated in FIG. 2A. In some embodiments, the readiness diagnostic process may be performed on the various components of the pumping equipment before or in coordination with filling the piping network with a volume of water.

In some embodiments, running the diagnostic test may include operating the mixing system 220, the liquid delivery system 234, and/or the mix water system 286 to circulate a fluid, e.g., water, through the piping network and/or the flow loop 274 at a plurality of flowrates and/or pressures to produce the plurality of periodic datasets, which generally includes data indicative of the performance of the pumping equipment or components thereof. In various embodiments, any suitable protocol suitable to generate the plurality of periodic datasets may be employed, although an example of a protocol is disclosed herein.

The pumping of wellbore servicing fluids can slowly degrade the pumping equipment by eroding the sealing capacity of seals and fatiguing fitted connections causing leaks. Leaks can cause a loss of pumping pressure, a reduced operational capacity, and in some cases, leaking of treating fluids from the pump unit. The automatic process can comprise a leak detection diagnostic process of the piping network, the main pump 206 a high pressure manifold coupled to the main pump 206, or combinations thereof. In some embodiments, a mix system leak diagnostic process can perform a diagnostic test on the health of a mix water system 286 by applying a static pressure level and monitoring the mixing system 220 for a predetermined time period. The diagnostic test can determine the pressure value to utilize in the test, e.g., target test pressure, based on a nominal operating valve, a maximum operating valve, or a pending operational value. For example, the pending operational value may be based on the needs of a current or anticipated pumping operation utilizing the pump unit 200. In some embodiments the mix system leak diagnostic process can access a pumping procedure comprising the steps, also called stages, of the current pumping operation to determine the pending operational value. In some embodiments, the diagnostic process can prompt the service personnel for the anticipated pumping pressures, e.g., pending operational value, of the current and/or anticipated pumping operation. The diagnostic process can determine the target test pressure by identifying the maximum pumping pressure from the pumping procedure or the service personnel and applying a safety factor. For example, the diagnostic process can determine a target test pressure by adding a safety factor, e.g., 1,000 psi, to a pending operational value.

In some embodiments, the readiness diagnostic process can execute before or in coordination with the mix system leak diagnostic. In some embodiments, the diagnostic process can establish a flow path through the piping network and fill the mixing system 220 with a volume of water as previously described. In some embodiments, the mix system leak diagnostic process may circulate water through the piping network for predetermined period of time. In some embodiments, the diagnostic process may close the sensor valve 276 to isolate the return line 278 and open the supply line 212 to a water source. In some embodiments, the mix system leak diagnostic can utilize supply pump 214 to apply a predetermined pressure value, e.g., test pressure, to the mix system 220. In this scenario, leak diagnostic can apply test pressure to the supply tank 202, liquid delivery system 234, mix drum 204, mix water system 286, and the inlet manifold to the main pump 206 as will be described herein after. In some embodiments, the leak diagnostic process can dose the mix valve 226 to exclude the inlet manifold of the main pump 206 from the mix system 220. In some embodiments, the leak diagnostic can apply test pressure with the supply pump 224 to exclude the supply tank 202 from the mix system 220 pressure test.

The mix system leak diagnostic can determine the health of the mix system 220 by identifying the existence or the absence of a leak with a pressure detection protocol. The leak diagnostic may identify a pending operational value, a target test pressure, and an emergency release value. The pending operational value can be an anticipated job pressure. The target test pressure can be the anticipated job pressure plus a safety factor, e.g., 1,000 psi. The emergency release value (ERV) can be based on the target test pressure or the maximum operating pressure. For example, the ERV can be the target test pressure plus a safety factor, e.g., 1,500 psi. The leak diagnostic can stop the pump, e.g., supply pump, open a valve e.g., sensor valve 276, or combinations thereof in response to the measured pressure within the mix system 220 reaching or exceeding the ERV. In some embodiments, the pending operational value can be the nominal operating value, for example, an average operational pressure for the pump unit 200. In some embodiments, the pending operational value can be the maximum allowable operating pressure, e.g., maximum working pressure. In some embodiments, the target test pressure can be the maximum test pressure of the pumping unit 200. In some embodiments, the ERV value can be the target test pressure or the maximum test pressure of the pumping unit 200.

The mix system leak diagnostic can apply pressure to the mix system 220 with the valves configured as previously described. The leak diagnostic can set the ERV for a pressure value consisting of the target test pressure plus a safety factor. In some embodiments, the leak diagnostic can increase the pressure level within the mixing system 220 in stepped values. For example, the leak diagnostic may increase the pressure level to 25%, 50%, or 75% of the target pressure valve and hold the step value for a predetermined period of time. In a scenario, the leak diagnostic may increase the pressure level within the mix system 220 to 50% of the target pressure and hold the stepped pressure for 10 minutes. The application of a stepped pressure hold can determine a leak, e.g., the health, at a lower pressure than the target test pressure. The leak diagnostic can increase the pressure level within the mix system 220 to the test pressure value. The mix system diagnostic can receive periodic datasets indicative of the health of the mix system 220 during the predetermined target pressure hold time. The diagnostic process can determine the health of the mix system 220 by comparing the pressure response to a pressure test threshold also referred to as a pass/fail criteria. The pressure response of the mix system 220 can be a reduction in pressure value over a time period, e.g., target pressure hold time. An initial pressure loss can be expected as the seals within the pumping equipment move and/or deflect while in contact with the sealing surfaces. For example, the seals on the supply tank 202 access port may deflect from 10% to 80% in contact with a seal surface due to the applied pressure, e.g., target pressure. The diagnostic process may actuate the supply pump 214 to replace the initial pressure loss. The diagnostic process can monitor the pressure response via periodic datasets from the sensor valves 216, 270, 226 or other pressure sensors. The pressure response can be steady, e.g., zero pressure change, or a change in pressure during the target pressure hold time. The diagnostic process can compare the pressure response to a predetermined pressure test threshold. The predetermined pressure test threshold can be based on a volume of liquid loss, a decrease in pressure, or a rate of decrease in pressure. For example, the predetermined pressure test threshold can be a total pressure loss of 100 psi. In another scenario, the test threshold can be 100 psi n 60 minutes. In still another scenario, the test threshold can be a 20 percent loss of pressure in 60 minutes. The diagnostic process can determine the health of the mix system 220 based on the comparison of the pressure response to the predetermined pressure test threshold. The periodic datasets and the determination of the health of the mix system 220 can be i) saved to memory, ii) saved to secondary storage 522, iii) communicated via transceiver 590 and/or network device 588 to a remote location, iv) sent as an alert to the service personnel, v) provided as an indicia to the service personnel via display 244, or vi) combinations thereof.

Turning now to FIG. 3, the automatic process can comprise a leak detection diagnostic process of the main pump 206 and a high pressure manifold. In some embodiments, a high pressure manifold leak diagnostic process, also referred to as a manifold leak diagnostic, can perform a diagnostic test on the health of a high pressure manifold 300 by applying a target test pressure and monitoring the pressure manifold 300 for a predetermined time period.

In some embodiments, the readiness diagnostic process can execute before or in coordination with the manifold leak diagnostic. In some embodiments, the diagnostic process can open the mix valve 226 coupled to the mix drum 204A to fill the high pressure line 326 and intake manifold 310 with water. The diagnostic process can isolate one side of the discharge manifold 312 by closing sensor valve 314. For example, the diagnostic process can close the sensor valve 314B to isolate exhaust manifold 312A and the high pressure line 336 from other side or exhaust manifold 312B. In some embodiments, the manifold leak diagnostic process may circulate water through the mix system 220 before opening the mix valve 226 to supply water to the intake manifold 310A.

In some embodiments, the manifold leak diagnostic can apply pressure to the high pressure manifold 300. The manifold leak diagnostic can set the ERV for a pressure value consisting of the target test pressure plus a safety factor. In this scenario, the ERV may stop the main pump 206A, disengage the power end from the fluid end, engage a break on the drive shaft of the power end, or combinations thereof. In some embodiments, the manifold leak diagnostic can utilize main pump 206A to apply a predetermined pressure value, e.g., test pressure, to the pressure manifold 300. In this scenario, manifold leak diagnostic can engage the main pump 206A to pressurize water from the intake manifold 310A to apply test pressure to the exhaust manifold 312A, the discharge hub 316, the high pressure line 336, and the test block 340. In some embodiments, the leak diagnostic process can leave the sensor valve 314B open, e.g., 100% open, to apply test pressure to the exhaust manifold 312B. In some embodiments, the manifold leak diagnostic can apply test pressure with both main pump 206A and 206B to both exhaust manifolds 312A, 312B and high pressure line 336.

In some embodiments, the manifold leak diagnostic can increase the pressure level in stepped values. For example, the manifold leak diagnostic may increase the pressure level to 25%, 50%, or 75% of the target pressure valve and hold the step value for a predetermined period of time. The manifold leak diagnostic can increase the pressure level within the pressure manifold 300 to the test pressure value. The manifold leak diagnostic can receive periodic datasets indicative of the health of the high pressure manifold 300 during the predetermined target pressure hold time. The diagnostic process can determine the health of the high pressure manifold by comparing the pressure response to a pressure test threshold also referred to as a pass/fail criteria. The pressure response of the high pressure manifold can be a reduction in pressure value over a time period, e.g., target pressure hold time. An initial pressure loss can be expected as the seals within the pumping equipment move and/or deflect while in contact with the sealing surfaces. The diagnostic process may actuate the main pump 206A to replace the initial pressure loss. The diagnostic process can monitor the pressure response via periodic datasets from the sensor valves 314A, 314B, 342, the pressure transducer 344 on the test block 340 or other pressure sensors. The pressure response can be steady, e.g., zero pressure change, or a change in pressure during the target pressure hold time. The diagnostic process can compare the pressure response to a predetermined pressure test threshold. The predetermined pressure test threshold can be based on a volume of liquid loss, a decrease in pressure, or a rate of decrease in pressure. For example, the predetermined pressure test threshold can be a total pressure loss of 100 psi. In another scenario, the test threshold can be 100 psi in 60 minutes. In still another scenario, the test threshold can be a 20 percent loss of pressure in 60 minutes. The diagnostic process can determine the health of the high pressure manifold 300 based on the comparison of the pressure response to the predetermined pressure test threshold. The periodic datasets and the determination of the health of the high pressure manifold 300 can be i) saved to memory, ii) saved to secondary storage 522, iii) communicated via transceiver 590 and/or network device 588 to a remote location, iv) sent as an alert to the service personnel, v) provided as an indicia to the service personnel via display 244, or vi) combinations thereof.

The automatic process may complete multiple diagnostic methods configured to determine the health of the pumping equipment of a pumping unit, e.g., pumping unit 200, and provide an indicia to the service personnel of the end of the automatic process. The automatic process may provide at least one report, alert, or display of an indicia that the health of the pumping equipment is "good" or sufficient to perform the current pumping operation. The automatic process may indicate a "good" health and return control of the pumping unit 200 to the service personnel.

In some embodiments, the service personnel can provide a wellbore servicing operation at the conclusion of the automatic process. A liquid and/or treatment blend may be prepared within the pump unit, e.g., 34 of FIG. 1, as a wellbore treatment, e.g., a cementitious slurry. The pump unit, e.g., 34 of FIG. 1, can mix the treatment blend and the liquid blend within the mixing equipment, e.g., 44 of FIG. 1, to form a treatment slurry and pump the treatment slurry into the wellbore 16 with the pumping equipment 46 via the supply line 38. The pumping unit 34 can deliver the treatment slurry into the wellbore 16 at a desired flowrate per the pumping procedure. Turning back to FIG. 2, the flowrate of the blended slurry from the pump unit 200 to the wellbore 16 can be controlled by the unit controller 240. The liquid delivery system 234 can transfer a liquid, e.g., water, from the supply tank 202 and/or supply line 212 to the mixing drum 204 at a predetermined flowrate per the pumping procedure to create the blended slurry within the mixing system 220 for delivery to the wellbore 16 via the main pump 206. The operational capacity of the liquid delivery system 234 to deliver fluid at a desired or predetermined flowrate can depend on the health of the mixing system 220.

As will be appreciated by those of skill in the art upon viewing this disclosure, a current or anticipated pumping operation may require that the mixing system 220 be able to provide certain operational performance values, e.g., a combined pressure and flowrate, less than the minimum operational capacity of the mixing equipment. However, a change in wellbore conditions may require the mixing system 220 to perform at a higher operational performance value that may include the minimum operational capacity. As such, it is important to understand the operational capacity of the liquid delivery system 234 prior to beginning a wellbore servicing operation at a wellsite.

In another scenario, the automatic process may provide at least one report, alert, or display of an indicia that the health of the pumping equipment is "bad" or insufficient to perform the current pumping operation. The automatic process may indicate a health level below the operational needs of the current pumping operation provide an indication of the failure mode, and return control of the pumping unit 200 to the service personnel.

In some embodiments, the health of the pumping equipment, e.g., the pressure manifold 300, can be determined based on the results of at least one of the diagnostic tests. In some embodiments, the results, or set of results, of the diagnostic test may comprise one or more averaged values, a plurality of averaged values, a system performance curve, a system mathematical function, or combination thereof. In some embodiments, the diagnostic process may include data processing of the periodic dataset after the completion of the diagnostic test. The diagnostic process may produce a post-processing periodic dataset from the periodic dataset by applying one or more data reduction techniques to smooth the periodic set of data, for example, data cleansing, numerosity reduction, or a combination thereof, to remove out-of-range values and flag missing values within the dataset. The data processing may include averaging of the post-processing periodic dataset to produce an averaged value, or set of averaged values, representative for each set of periodic data. The average value may be a single value that represents a plurality of values across a given duration. The average value may be determined by applying one or more mathematical techniques such as an arithmetic mean, a median, a geometric median a mode, a geometric mean, a harmonic mean, a generalized mean, a moving average, or combination thereof. In some embodiments, the average value may be determined as each of the plurality of periodic datasets is generated, for example, in real-time or, alternatively, at a later time. The results, or set of results, of the at least one diagnostic tests can be determined by data processing the periodic datasets.

In some embodiments, the health of the pumping equipment can be determined by comparing the results of the at least one diagnostic test to a minimum operational capacity for the pumping equipment, e.g., the mixing system 220. Additionally or alternatively, the results of the diagnostic test can be compared to a maintained operational capacity, for example, an expected capacity based upon prior use and maintenance of the pumping equipment, e.g., mixing system 220. Additionally or alternatively, the results of the diagnostic test can be compared a historical database, for example, a capacity based upon historical data from multiple pump units, e.g., pump unit 200, main pump, mixing systems, and various components.

In some embodiments, the results of at least one of the diagnostic tests may be compared to an operational indicator set, which may comprise a readiness check, the minimum operational capacity, a nominal operational capacity, a series of failure modes, or combinations thereof.

In some embodiments, the nominal operational capacity can comprise one or more values indicative of the normal operational capacity of a well-maintained or recently-serviced portion of the pump unit 200, e.g., the mixing system 220. A values of the readiness diagnostic, the liquid supply diagnostic, mix water diagnostic, mix system leak diagnostic, manifold leak diagnostic, or combinations thereof can be indicative of the nominal operational capacity of the pumping equipment of the pumping unit 200.

In some embodiments, the failure modes may comprise one or more values indicative of one or more failure modes, e.g., bearing failure, of the pumping equipment. The values of the failure modes can be indicative of one or more failures of the pumping equipment, e.g., mixing system 220, or a component thereof. For example, failure of the supply pump 224 to achieve a pressure value during the diagnostic test may be indicative of an imminent seal failure.

The results from the comparison between the results of at least one of the diagnostic tests and the operational indicator set may yield a status for the pumping equipment. For example, where the diagnostic test results meets or exceeds the values of pending operational capacity, the mixing system 220 may have a "passing" or "acceptable" status; where it does not, the mixing system may have a "failing" or unacceptable status. Additionally or alternatively, where the diagnostic test results meets or exceeds the values of the minimum operational capacity, check, the mixing system 220 may have a "passing" or "acceptable" status; where it does not, the mixing system may have a "failing" or unacceptable status. Additionally or alternatively, where the diagnostic test results meets or exceeds the values of the nominal operational capacity, check, the mixing system 120 may have a "passing" or "acceptable" status; where it does not, the mixing system may have a "failing" or unacceptable status. Additionally or alternatively, where the diagnostic test results meets or exceeds the series of failure modes, the mixing system 220 may have a "passing" or "acceptable" status; where it does not, the mixing system may have a "failing" or unacceptable status.

In some embodiments, the method for determining health of the pumping equipment may further comprise the step of creating one or more outputs responsive to the status of the pumping equipment. The output may comprise indicia of the health of the pumping equipment, e.g., the pressure manifold 300, for example, a visual cue (e.g., an indicator light), textual information or messages indicating the pressure manifold 300 status, an audible cue such as an alarm or a buzzer, or combinations thereof.

For example, referring again to FIG. 2, the unit controller 240 may display an alert on the interactive display 244. The alert may be displayed on the interactive display 244 as a curve, a table, or a simple pass or fail, e.g., pass/fail status. For example, a pass/fail status may be a color indicator including a green color for a passing status while a failing status can be a red color. A pass/fail status can include a multiple color indicator to indicate a range such as green, yellow, and red. The yellow can be a warning of a bottom of the range value. A pass/fail message, e.g., text message, may be included when the result is a fan.

In some embodiments, the pump unit 34 may monitor the pump usage of at least one pump, e.g., pumping equipment 46 of FIG. 1, to determine if the pumping equipment, e.g., pumping equipment 46, requires maintenance. The unit controller 48 may load one or more processes into memory to track pumping equips ent usage. The one or more processes may be applications that are loaded when the unit controller 48 is started or before a pumping procedure begins. A managing process executing on the unit controller 48 may load a current pump dataset comprising a pump usage log for each of the pumps, e.g., mix pump 284. A pump maintenance log may be created and/or maintained by one or more diagnostic processes and/or the managing process. The pump maintenance log comprises at least one value indicative of a past maintenance event such as pump identification, repair performed, location, or date. The pump usage log and a pump maintenance log may also be referred to as a historical datasets. The pump usage log comprises pump usage values Indicative of a wellbore pumping operation such as pump flowrate, pump pressure, fluid volume, or combinations thereof. The unit controller 48 can update the pump usage log with pump usage values comprising periodic sensor data indicative of the pumping operation. For example, the unit controller 48 may start a pumping procedure comprising a sequential series of steps including the wellbore treatment fluid blend, the pump pressures, the pump flowrates, the fluid volumes, or combinations thereof to place a wellbore treatment into a wellbore and the managing process can update the pump usage log based on the time period and/or volume of treatment pumped.

In some embodiments, the automatic process can determine a probability of a future maintenance event. The diagnostic process can input one or more of the diagnostic test results to a pump usage log, a pump maintenance log into a predictive maintenance model. The predictive maintenance model may access a historical database of pumping operations for the type of pumping unit, e.g., pump unit 34. The predictive maintenance model may output a probability of a future maintenance event by utilizing the results of the current diagnostic testing, past results of the diagnostic testing, a historical database of pumping operations, the pump usage log, the pump maintenance log, or a combination thereof as inputs. The future maintenance event may include a decline in performance, an imminent equipment failure, a cataphoric equipment failure, or combinations thereof. The performance of the pumping equipment, e.g., the pumping equipment 46, may decline as the accumulation of pump usage values approaches the usage threshold of the future maintenance event. The pump performance decline may include a deterioration of the pumping capabilities, e.g., decrease in pressure or flowrate capabilities, and/or a catastrophic failure. A future maintenance event may be resolved by preventative maintenance on the pump equipment including an adjustment, a replacement of a component a major overhaul, or combinations thereof. The predictive maintenance model may provide a pump equipment life value comprising the remaining pump usage values before the future maintenance event. The diagnostic process can provide a probability of a future maintenance event for the pressure manifold 300, the main pump 206, the mix pump 284, the supply pumps 224 and 214, the mix water system 286, the mixing system 220, the liquid delivery system 234, and all of the various components thereof.

In some embodiments, one or more of the steps of assessing the plurality of periodic datasets, determining the health of the pumping equipment, and creating one or more outputs responsive to the status of the mixing system may be carried out via the operation of the unit controller 240.

A unit controller, for example, the unit controller 48 of FIG. 1 or the unit controller 240 of FIG. 2, may be a computer system suitable for communication and control of various components of the pumping unit. An embodiment a unit controller, for example, the unit controller 48 of FIG. 1 or the unit controller 240 of FIG. 2, is illustrated in FIG. 5 as a computer system 510. In the embodiment of FIG. 5, the computer system 510 includes one or more processors 512 (which may be referred to as a central processor unit or CPU) that is in communication with memory 520, secondary storage 522 input output devices 524, DAQ card 532, and network devices 528. The computer system 510 may continuously monitor the state of the input devices and change the state of the output devices based on a plurality of programmed instructions. The programming instructions may comprise one or more applications retrieved from memory 520 for executing by the processor 578 in non-transitory memory within memory 520. The input output devices may comprise a HMI, e.g., interactive display 244 in FIG. 2, with a display screen and/or the ability to receive conventional inputs from the service personnel such as push button, touch screen, keyboard, mouse, or any other such device or element that a service personnel may utilize to input a command to the computer system 510. The secondary storage 522 may comprise a solid state memory, a hard drive, or any other type of memory suitable for data storage. The secondary storage 522 may comprise removable memory storage devices such as solid state memory or removable memory media such as magnetic media and optical media, i.e., CD disks. The computer system 510 can communicate with various networks with the network devices 528 comprising wired networks, e.g., Ethernet or fiber optic communication, and short range wireless networks such as Wi-Fi (i.e., IEEE 802.11), Bluetooth, or other low power wireless signals such as ZigBee Z-Wave, 6LoWPan, Thread, and WiFi-ah. The computer system 510 may include a long range radio transceiver 590 for communicating with mobile network providers as will be disclosed further herein.

The computer system 510 may comprise a DAQ card 532 for communication with one or more sensors. The DAQ card 532 may be a standalone system with a microprocessor, memory, and one or more applications executing in memory. The DAQ card 532, as illustrated, may be a card or a device within the computer system 510. In an embodiment, the DAQ card 532 may be combined with the input output device 584. The DAQ card 532 may receive one or more analog inputs 534 one or more frequency inputs 536, and one or more Modbus inputs 538. For example, the analog input 594 may include a tub level sensor. For example, the frequency input 536 may include a flow meter, i.e., 256 from FIG. 2B. For example, the Modbus input 538 may include a pressure transducer, i.e., 264 from FIG. 2B. The DAQ card 532 may convert the signals received via the analog input 534, the frequency input 536, and the Modbus input 538 into the corresponding sensor data. For example, the DAQ card 532 may convert a frequency input 596 from the flowrate sensor 256 shown in FIG. 2B into flow rate data measured in gallons per minute (GPM).

Additionally or alternatively, in an embodiment one or more of the steps of assessing the plurality of periodic datasets, determining the health of the pumping equipment, and/or creating one or more outputs responsive to the status of the mixing system may be carried out via the operation of a computer located at a remote location, for example, a remote service center. Additionally or alternatively, in an embodiment, one or more of the steps of assessing the plurality of periodic datasets, determining the health of the pumping equipment, and/or creating one or more outputs responsive to the status of the mixing system may be carried out cooperatively via the operation of the unit controller 240 and a computer located at the remote location for example, the remote service center. For example, in an embodiment, the unit controller 240 may transmit data from the diagnostic test, e.g., the pressure manifold 300 leak diagnostic, to a remote service center as will be described further therein, for example, via a data communication system.

Figure 6A:
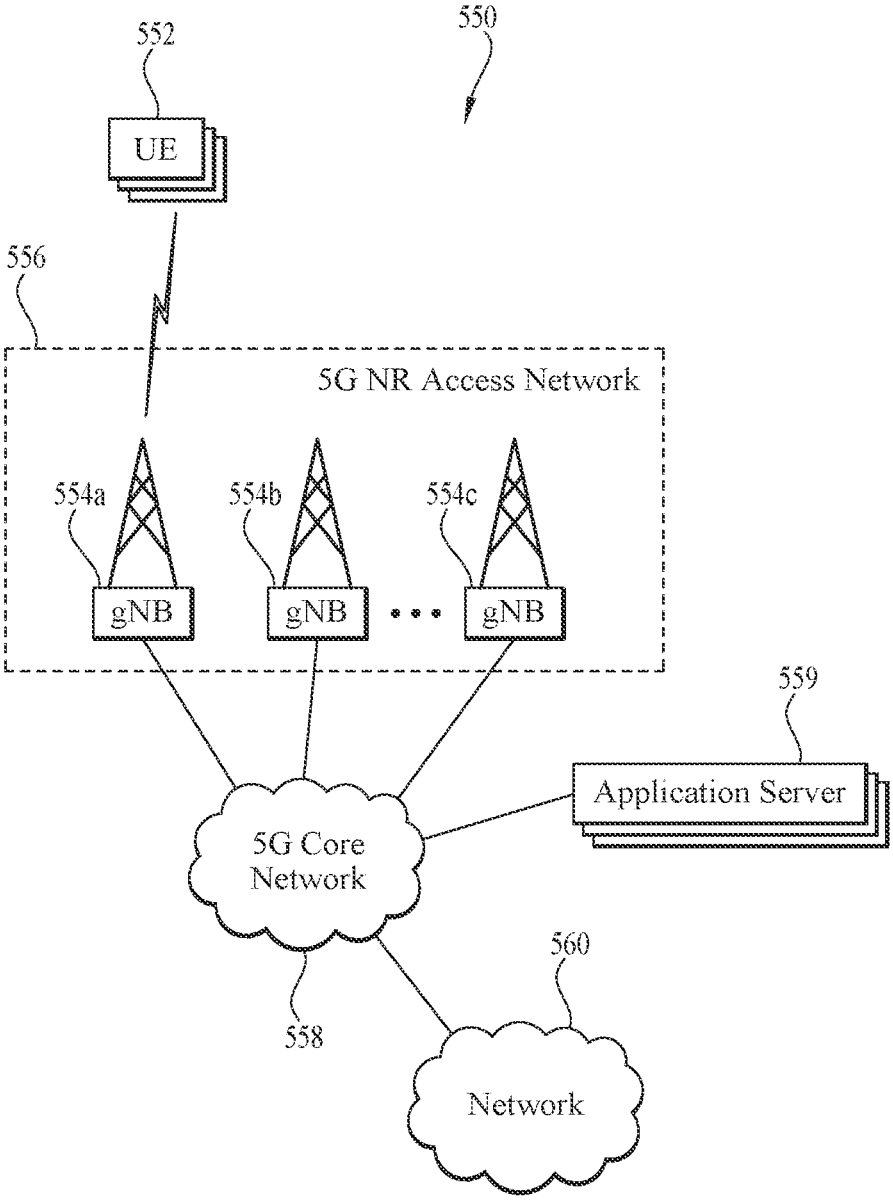
FIG. 6A is a block diagram of an exemplary communication system according to an embodiment of the disclosure.
Figure 9B:
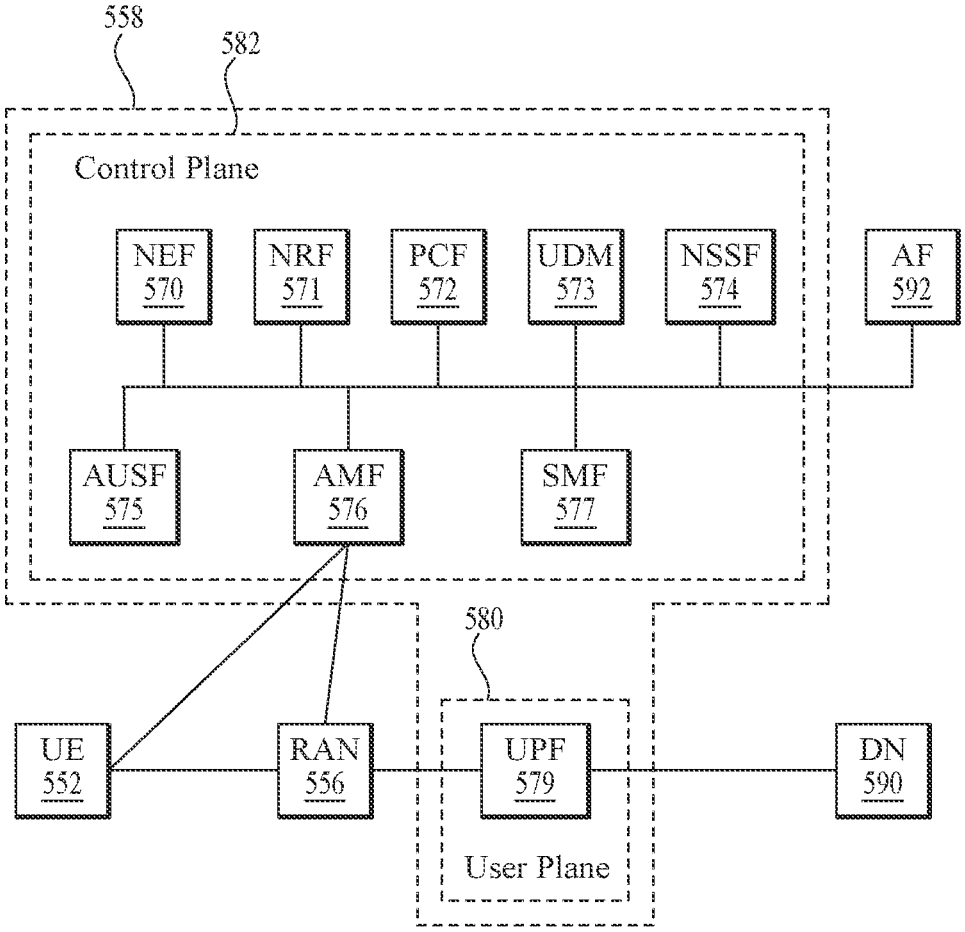

For example, data can be transmitted, via a data communication system, and received by various wired or wireless means between the pump unit 200 at a wellsite and a remote service center and for further processing. Referring to FIG. 6, a data communication system 600 is described. The data communication system 600 comprises a pump unit 34 disposed at a wellsite 602, an access node 610 (e.g., cellular site), a mobile carrier network 654, a network 634, a storage computer 636, a service center 638, and a plurality of user devices 652. The pump unit 34 can include a communication device 606 (e.g., transceiver 590 of FIG. 5) that can transmit and/or receive via any suitable communication means (wired or wireless), for example, to wirelessly connect to an access node 610 to transmit data (e.g., the system performance file) to a storage computer 636. The storage computer 636 may also be referred to as a data server, data storage server, or remote server. The storage computer 636 may include a database, which may be used to store system performance files and/or diagnostic test results. Wireless communication can include various types of radio communication, including cellular, satellite 630, or any other form of long range radio communication. The communication device 606 can transmit data via wired connection for a portion or the entire way to the storage computer 636. The communication device 606 may communicate over a combination of wireless and wired communication. For example, communication device 606 may wirelessly connect to access node 610 that is communicatively connected to a network 634 via a mobile carrier network 654.

In an embodiment, the communication device 606 on the pump unit 34 is communicatively connected to the mobile carrier network 654 that may comprise the access node 610, a 5G edge site 612, a 5G core network 620, and the network 634. The communication device 606 may be the transceiver 590 connected to the computer system 676 of FIG. 5. The computer system 510 may be the unit controller 240 of FIG. 2 or unit controller 48 of FIG. 1, thus the communication device 606 may be communicatively connected to the unit controller 240 and/or 48.

The access node 610 may also be referred to as a cellular site, cell tower, cell site, or, with 5G technology, a gigabit Node B. The access node 610 provides wireless communication links to the communication device 606, e.g., unit controller 240 and/or unit controller 48, according to a 5G, a long term evolution (LTE), a code division multiple access (CDMA), or a global system for mobile communications (GSM) wireless telecommunication protocol.

The communication device 606 may establish a wireless link with the mobile carrier network 654 (e.g., 5G core network 620) with a long-range radio transceiver, e.g., 590 of FIG. 5, to receive data, communications, and, in some cases, voice and/or video communications. The communication device 606 may also include a display and an input device (e.g., interactive display 144 or HMI), a camera (e.g., video, photograph, etc.), a speaker for audio, or a microphone for audio input by a user. The long-range radio transceiver, e.g., transceiver 590, of the communication device 606 may be able to establish wireless communication with the access node 610 based on a 5G LTE, CDMA, or GSM telecommunications protocol. The communication device 606 may be able to support two or more different wireless telecommunication protocols and, accordingly, may be referred to in some contexts as a multi-protocol device. The communication device 606, e.g., device 606A, may communicate with another communication device, e.g., device 606B, on a second pump truck, e.g., pump unit 34B, via the wireless link provided by the access node 610 and via wired links provided by the mobile carrier network 654, e.g., 5G edge site 612 or the 5G core network 620. Although the pump unit 34 and the communication device 606 are illustrated as a single device, the pump unit 34 may be part of a system of pump units, e.g., a frac fleet. For example, a pump unit 34A may communicate with pump units 34B, 340, 34D, 34E, and 34F at the same wellsite, e.g., wellsite 602 of FIG. 6, or at multiple wellsites. In an embodiment, the pump units 34A-E may be a different types of pump units at the same wellsite or at multiple wellsites. For example, the pump unit 34A may be a frac pump, pump unit 34B may be a blender, pump unit 34C may be water supply unit pump unit 34D may be a cementing unit, and pump unit 34E may be a mud pump. The pump unit 34A-F may be communicatively coupled together at the same wellsite by one or more communication methods. The pump units 34A-F may be communicatively coupled with a combination of wired and wireless communication methods. For example, a first group of pump units 34A-C may be communicatively coupled with wired communication, e.g., Ethernet. A second group of pump units 34D-E may be communicatively couple to the first group of pump units 34A-C with low powered wireless communication, e.g., WIFI. A third group of pump units 34F may be communicatively coupled to one or more of the first group or second group of pump units by a long range radio communication method, e.g., mobile communication network 654.

The 5G edge site 612 can be communicatively coupled to the access node 610. The 5G edge site 612 may also be referred to as a regional data center (RDC) and can include a virtual network in the form of a cloud computing platform. The cloud computing platform can create a virtual network environment from standard hardware such as servers, switches, and storage. The total volume of computing availability 614 of the 5G edge site 612 is illustrated by a pie chart with a portion illustrated as a network slice 618 and the remaining computing availability 616. The network slice 618 represents the computing volume available for storage or for processing of data. The network slice 618 may be referred to as a network location. The cloud computing environment is described in more detail, further hereinafter. Although the 5G edge site 612 is shown communicatively coupled to the access node 610, it is understood that the 5G edge site 612 may be communicatively coupled to a plurality of access nodes (e.g., node 610). The 5G edge site 612 may receive all or a portion of the voice and data communications from one or more access nodes (e.g., node 610). The 5G edge site 612 may process all or a portion of the voice and data communications or may pass all or a portion to the 5G core network 620 as will be described further hereinafter. Although the virtual network is described as created from a cloud computing network, it is understood that the virtual network can be formed from a network function virtualization (NFV). The NFV can create a virtual network environment from standard hardware such as servers, switches, and storage. The NFV is more fully described by ETSI GS NFV 002 v1.2.1 (2014-12).

The 5G core network 620 can be communicatively coupled to the 5G edge site 612 and provide a mobile communication network via the 5G edge site 612 and one or more access node 610. Although the access node 610 is illustrated as communicatively connected to the 5G edge site 612, it is understood that one or more access nodes, e.g., 610, may be communicatively connected to the 5G core network 620. The 5G core network 620 can include a virtual network in the form of a cloud computing platform. The cloud computing platform can create a virtual network environment from standard hardware such as servers, switches, and storage. The total volume of computing availability 622 of the 5G core network 620 is illustrated by a pie chart with a portion illustrated as a network slice 626 and the remaining computing availability 624. The network slice 626 may be referred to as a network location. The network slice 626 represents the computing volume available for storage or processing of data. The cloud computing environment is described in more detail further hereinafter. Although the 5G core network 620 is shown communicatively coupled to the 5G edge site 612, it is understood that the 5G core network 620 may be communicatively coupled to a plurality of access nodes (e.g., nodes 610) in addition to one or more 5G edge sites (e.g., edge sites 612). The 5G core network 620 may be communicatively coupled to one or more Mini Data Centers (MDC). MDC may be generally described as a smaller version or self-contained 5G edge site comprising an access node, e.g., node 610, with a cloud computing platform, e.g., a virtual network environment, created from standard computer system hardware, e.g., processors, switches, and storage. The 5G core network 620 may receive all or a portion of the voice and data communications via 5G edge site 612, one or more MDC nodes, and one or more access nodes (e.g., nodes 610). The 5G core network 620 may process all or a portion of the voice and data communications as will be described further hereinafter. Although the virtual network is described as created from a cloud computing network, at is understood that the virtual network can be formed from a network function virtualization (NFV). The NFV can create a virtual network environment from standard hardware such as servers, switches, and storage.

A storage computer 636 can be communicatively coupled to the 5G network, e.g., mobile carrier network 654, via the network 634. The storage computer 636 can be a computer, a server, or any other type of storage device. The storage computer 636 may be referred to as a network location. The network 634 can be one or more public networks, one or more private networks, or a combination thereof, A portion of the Internet can be included in the network 634.

The service center 638 may serve as a base of operations for a plurality of pump units, for example, providing maintenance for the pump unit 34. Maintenance operations can include repair, replacement, modification, upgrades, or a combination thereof of the equipment on the pump unit 34 including, referring back to FIG. 2, the unit controller 240, the DAQ card 242, the interactive display 244, i.e., HMI the power supply 208, the supply tank 202, the mixing system 220, the additive system 222, the main pump 206, the plurality of pumps, e.g., supply pump 224, the plurality of valves, e.g., sensor valve 270, the plurality of sensors, e.g., flowrate sensor 256, or combinations thereof.

The service center 638 may have a central computer 640 executing one or more applications, for example, a maintenance application 642. The maintenance application 642 may assign a pump unit, e.g., pump unit 34, for maintenance to one or more components on the pump unit, e.g., main pump 206, on the maintenance schedule 648. In an embodiment, the maintenance application 642 may receive or retrieve a diagnostic test results associated with the pump unit 34 from a historical database on the storage computer 636. The central computer 640 can access the diagnostic test results and determine if the results of the diagnostic test are below a threshold value or if the results include an alert indicating that the diagnostic test generated a fault value, error value, or at least one data point below an operational threshold. In some embodiments, the central computer 640, for example, the maintenance application 642, may send one or more alerts to one or more user devices 652 communicatively connected to the maintenance application 642 via the network 634. Additionally or alternatively, the central computer 640 may schedule service, for example, at the service center 638, to diagnose or remedy an issue with a pump unit 34 based upon the results of the diagnostic test, for example, to replace one or more seals within the supply pump 224. Additionally or alternatively, the unit controller 48 may assign the unit to service and/or schedule service, for example, at the service center 638, to diagnose or remedy an issue with a pump unit 34 based upon the results of the diagnostic test, for example, to replace one or more seals within the pumping equipment 46.

Although the maintenance application 642 is described as executing on a central computer 640, it is understood that the central computer 640 can be a computer system or any form of a computer system such as a server, a workstation, a desktop computer, a laptop computer, a tablet computer, a smartphone, in a cloud computing environment, or any other type of computing device. The central computer 640 (e.g., computer system) can include one or more processors, memory, input devices, and output devices, as described in more detail further hereinafter. Although the service center 638 is described as having the maintenance application 642 executing on a central computer 640, it is understood that the service center 638 can have 2, 3, 4, or any number of computers 640 (e.g., computer systems) with 2, 3, 4, or any number of maintenance applications 642 executing on the central computers 640.

In some embodiments, the mobile carrier network 654 includes a 5G core network 620 and a 5G edge site 612 with virtual servers in a cloud computing environment. One or more servers of the type disclosed herein, for example, storage computer 636 and central computer 640, can be provided by a virtual network function (VNF) executing within the 5G core network. The pump unit 34 on the wellsite 602 can be communicatively coupled to the 5G edge site 612, which includes the 5G core network 620 via the access node 610 (e.g., gigabit Node B) and thus can be communicatively coupled to one or more VNFs with virtual servers as will be more fully described hereinafter, Turning now to FIG. 7, a representative example of a network slice 618 and/or 626 is described. A computing service executing on network slice 618 and/or 626 can comprise a first virtual network function (VNF) 658, a second VNF 660, and an unallocated portion 662. The computing service can comprise a first application 664A executing on a first VNF 658 and a second application 666A executing on a second VNF 660. The first application 664A and second application 666A can be computing service applications generally referred to as remote applications. The total computing volume can comprise a first VNF 658, a second VNF 660, and an unallocated portion 662. The unallocated portion 662 can represent computing volume reserved for future use. The first VNF 658 can include a first application 664A and additionally allocated computing volume 664B. The second VNF 660 can include a second application 666A and additionally allocated computing volume 666B. Although two VNFs are illustrated, the network slice 618 and/or 626 can have a single VNF, two VNFs, or any number of VNFs. Although the first VNF 658 and second VNF 660 are illustrated with equal computing volumes, it is understood that the computing volumes can be non-equal and can vary depending on the computing volume needs of each application. The first application 664A executing in the first VNF 658 can be configured to communicate with or share data with the second application 666A executing in the second VNF 660. The first application 664A and second application 666A can be independent and not share data or communicate with each other. Although the network slice 618 and/or 626 is illustrated with two VNFs and an unallocated portion 662, the network slice 618 and/or 626 may be configured without an unallocated portion 662. Although only one application, a first application 664A, is described executing within the first VNF 658, two or more applications can be executing within the first VNF 658 and second VNF 660. In an embodiment, the network slice 618 and/or 626 may be the network slice 618 on the 5G edge site 612. In an embodiment, the network slice 626 may be the network slice 626 on the 5G core network 620. In an embodiment, the first application 664A and/or the second application 666A executing on the first VNF 658 and/or second VNF 660 may be the maintenance application 642, the maintenance schedule 648, the storage computer 636, the historical database of system performance files, or combination thereof.

Turning now to FIG. 8A, an embodiment of a communication system 550 is described suitable for implementing one or more embodiments disclosed herein, for example implementing communications or messaging as disclosed herein including without limitation, wireless communication between the communication device 606 and the mobile carrier network 654 on FIG. 6; communications with the computing components and network associated with FIG. 5 (e.g., long range radio transceiver 190); and the like. Typically, the communication system 550 includes a number of access nodes, a first access node 554*a*, a second access node 554*b*, and a third access node 554*c* (collectively, access nodes 554) that are configured to provide coverage in which a plurality of user equipment (UEs) 552 such as cell phones, tablet computers, machine-type-communication devices, unit controllers, tracking devices, embedded wireless modules, and/or other wirelessly equipped communication devices (whether or not user operated), can operate. The access nodes 554 may be said to establish an access network 556. The access network 556 may be referred to as a radio access network (RAN) in some contexts. In a 5G technology generation an access node 554 may be referred to as a gigabit Node B (gNB). In 4G technology (e.g., long term evolution (LTE) technology) an access node 554 may be referred to as an enhanced Node B (eNB). In 3G technology (.e.g., code division multiple access (CDMA) and global system for mobile communication (GSM)) an access node 554 may be referred to as a base transceiver station (BTS) combined with a basic station controller (BSC). In some contexts, the access node 554 may be referred to as a cell site or a cell tower. In some implementations, a picocell may provide some of the functionality of an access node 554, albeit with a constrained coverage area. Each of these different embodiments of an access node 554 may be considered to provide roughly similar functions in the different technology generations.

It is understood that the access network 556 may include any number of access nodes 554. Further, each access node 554 could be coupled with a core network 558 that provides connectivity with various application servers 559 and/or a network 560. In an embodiment, at least some of the application servers 559 may be located close to the network edge (e.g., geographically close to the UE 552 and the end user) to deliver so-called "edge computing." The network 560 may be one or more private networks, one or more public networks, or a combination thereof. The network 560 may comprise the public switched telephone network (PSTN). The network 560 may comprise the Internet. With this arrangement, a UE 552 within coverage of the access network 556 could engage in air-interface communication with an access node 554 and could thereby communicate via the access node 554 with various application servers and other entities.

The communication system 550 could operate in accordance with a particular radio access technology (RAT), with communications from an access node 554 to UEs 552 defining a downlink or forward link and communications from the UEs 552 to the access node 554 defining an uplink or reverse link. Over the years, the industry has developed various generations of RATs, in a continuous effort to increase available data rate and quality of service for end users. These generations have ranged from "1G," which used simple analog frequency modulation to facilitate basic voice-call service, to "4G"—such as Long Term Evolution (LTE), which now facilitates mobile broadband service using technologies such as orthogonal frequency division multiplexing (OFDM) and multiple input multiple output (MIMO).

Turning now to FIG. 8B, further details of the core network 558 are described. In an embodiment, the core network 558 is a 5G core network. 5G core network technology is based on a service based architecture paradigm. Rather than constructing the 5G core network as a series of special purpose communication nodes (e.g., an HSS node, a MME node, etc.) running on dedicated server computers, the 5G core network is provided as a set of services or network functions. These services or network functions can be executed on virtual servers in a cloud computing environment which supports dynamic scaling and avoidance of long-term capital expenditures (fees for use may substitute for capital expenditures). These network functions can include, for example, a user plane function (UPF) 579, an authentication server function (AUSF) 575, an access and mobility management function (AMF) 576, a session management function (SMF) 577, a network exposure function (NEF) 570, a network repository function (NRF) 571, a policy control function (PCF) 572, a unified data management (UDM) 573, a network slice selection function (NSSF) 574, and other network functions. The network functions may be referred to as virtual network functions (VNFs) in some contexts.

Network functions may be formed by a combination of small pieces of software called microservices. Some microservices can be re-used in composing different network functions, thereby leveraging the utility of such microservices, Network functions may offer services to other network functions by extending application programming interfaces (APIs) to those other network functions that call their services via the APIs. The 5G dare network 558 may be segregated into a user plane 580 and a control plane 582, thereby promoting independent scalability, evolution, and flexible deployment.

The NEF 570 securely exposes the services and capabilities provided by network functions. The NRF 571 supports service registration by network functions and discovery of network functions by other network functions. The POE 572 supports policy control decisions and flow based charging control. The UDM 573 manages network user data and can be paired with a user data repository (UDR) that stores user data such as customer profile information, customer authentication number, and encryption keys for the information. An application function 592, which may be located outside of the core network 558, exposes the application layer for interacting with the core network 558, In an embodiment, the application function 592 may be execute on an application server 559 located geographically proximate to the UE 552 in an "edge computing" deployment mode. The core network 558 can provide a network slice to a subscriber, for example an enterprise customer, that is composed of a plurality of 5G network functions that are configured to provide customized communication service for that subscriber, for example to provide communication service in accordance with communication policies defined by the customer. The NSSF 574 can help the AMF 576 to select the network slice instance (NSI) for use with the UE 552.

The systems and methods disclosed herein may be advantageously employed in the context of wellbore servicing operations, particularly, in relation to the usage of wellbore servicing equipment as disclosed herein.

In an embodiment, the diagnostic test disclosed herein may identify equipment failures or decreases in operability that might not otherwise be identifiable. For example, a reduction in pump output of a pump (e.g., the supply pump 224) may be gradual and difficult to quantify or identify. The diagnostic test disclosed herein, in which a partly dosed sensor valve 270 can increase the head pressure while decreasing the flowrate of the supply pump 224 can impart additional stress and can reveal a decrease in the pump output and thus a decrease in the operational capacity of the liquid delivery system 234.

Additionally or alternatively, the diagnostic test disclosed herein may be automatically performed prior to the initiation of a wellbore servicing operation, at the completion of a wellbore servicing operation, or both. The unit controller 240 may automatically initiate the diagnostic test upon startup or shutdown of the pumping unit 200, or may prompt the service personnel to initiate the diagnostic test. The unit controller 240 may prevent operation of the pumping unit 200 until the diagnostic test is completed.

Additionally or alternatively, the diagnostic test disclosed herein may determine if the pumping unit 200 can complete a wellbore servicing operation without interruption. The diagnostic test can determine if one or more components of the pumping equipment, e.g., the mixing system 220, can operate within operational limits of pumping unit 200. Additionally, the diagnostic test can determine if one or more components of the pumping equipment, e.g., mixing system 220, has decreased in operational capacity below a threshold value.

ADDITIONAL DISCLOSURE

The following are non-limiting, specific embodiments in accordance with the present disclosure:

A first embodiment, which is a computer-implemented method of determining a health status of a mixing system associated with a wellbore pump unit, the method comprising: initiating, by a unit controller, a diagnostic process comprising at least one diagnostic test, and wherein the unit controller comprises a processor, a non-transitory memory, and an input output device; performing, by the unit controller, the at least one diagnostic test; determining, by the diagnostic process, a set of results of the diagnostic test; comparing the set of results of the diagnostic test to an operational indicator set; determining the health status of the pumping equipment system based upon the comparison; and outputting, by the unit controller, indicia of the health status of the pumping equipment via the input output device, wherein the indicia of the health status of the pumping equipment comprises a visual cue, and audible cue, or both A second embodiment, which is the method of the first embodiment, wherein the at least one diagnostic test comprises: configuring a plurality of sensor valves to configure a piping network; filling the piping network with a volume of water; operating a pump to establish 1) a flowrate of water, 2) a target pressure value, or 3) both; measuring, by at least one sensor, a periodic dataset; and storing the periodic dataset, wherein the periodic dataset is associated with the operation of the pump and the configuration of the piping network.

A third embodiment, which is the method of the first embodiment, wherein the at least one diagnostic test is an intake manifold diagnostic test, wherein the intake manifold diagnostic test comprises: configuring a flow path through a piping network by positioning a plurality of sensor valves into a first flow path position, wherein the flow path includes an intake header located between a high pressure line and a fluid end; operating a supply pump at full speed to communicate a fluid via the flow path and closing a valve coupled to a return line; and measuring, by at least one sensor, a first periodic dataset of pressure and flowrate while the fluid is communicated via the flow path with the sensor valve in a first position that is fully open and the valve on the return line is dosed.

A fourth embodiment, which is the method of the first embodiment, wherein the at least one diagnostic test is an exhaust manifold diagnostic test, wherein the exhaust manifold test comprises: coupling a high pressure supply line between a discharge hub and a test block with a dosed valve; setting an emergency release value (ERV); operating a plunger pump to pump a volume of water and apply a target pressure value to the test block via the high pressure supply line; and measuring, by at least one sensor, a first periodic dataset of pressure.

A fifth embodiment, which is the method of the fourth embodiment, wherein the diagnostic process is configured to stop the plunger pump, disengage a power end from the fluid end, engage a break on a drive shaft of the power end, open a pressure relief valve, or combinations thereof if the ERV value is exceeded by the plunger pump.

A sixth embodiment, which is the method of any of the first through the fifth embodiments, further comprising determining, by the unit controller, a probability of a future maintenance event in response to the set of results of the diagnostic test, a pump usage log, a pump maintenance log, or combinations thereof.

A seventh embodiment, which is the method of the sixth embodiment, wherein the probability of a future maintenance event is determined by a predictive maintenance model.

An eighth embodiment, which is the method of the sixth or seventh embodiment, further comprising assigning, by the unit controller, the wellbore pump unit to a maintenance schedule at a service center in response to the probability of a future maintenance event.

A ninth embodiment, which is the method of any of the first through the eighth embodiments, wherein the operational indicator set comprises a configuration check, a minimum operational capacity, a nominal operational capacity, and a series of failure modes.

A tenth embodiment, which is the method of any of the first through the ninth embodiments, wherein the set of results of the diagnostic test comprises data processing of a periodic dataset to produce a set of averaged values.

An eleventh embodiment, which is the method of the tenth embodiment, wherein one or more of: generating the set of results from the data processed periodic datasets, comparing the set of results of the diagnostic test to the operational indicator set, and determining the health status of the pumping equipment based upon the comparison of the set of results of the diagnostic test and the operational indicator set is performed via the unit controller.

A twelfth embodiment, which is the method of the eleventh embodiment, wherein one or more of: data processing the periodic datasets, generating the set of results from the data processed periodic datasets, comparing the set of results of the diagnostic test to the operational indicator set, and determining the health status of the pumping equipment based upon the comparison of the set of results of the diagnostic test and the operational indicator set is performed via a remote computer.

A thirteenth embodiment, which is the method of the second through the twelfth embodiments, further comprising: transmitting the periodic datasets to a remote computer via a wireless communication protocol.

A fourteenth embodiment, which is the method of the thirteenth embodiment, wherein the wireless communication protocol is at least one of a 5G, a long-term evolution (LTE), a code division multiple access (CDMA), or a global system for mobile communications (GSM) telecommunications protocol.

A fifteenth embodiment, which is the method of the thirteenth embodiment, wherein the remote computer is disposed in a network location, wherein the network location is one of i) a VNF on a network slice within a 5G core network, ii) a VNF on a network slice within a 5G edge network, iii) a storage computer communicatively coupled to a network via a mobile communication network, or iv) a computer system communicatively coupled to the network via the mobile communication network.

A sixteenth embodiment, which is the method of the fifteenth embodiment, wherein the network location comprises a database, a storage device, the remote computer, a virtual network function, or combination thereof.

A seventeenth embodiment, which is the method of the fifteenth embodiment, further comprising accessing, by the remote computer, a historical database on the network location, the historical database comprising data associated with a plurality of pump units.

An eighteenth embodiment, which is a wellbore servicing method comprising: transporting a pump unit to a website, wherein the pump unit comprises a unit controller configured to perform a diagnostic test, wherein the unit controller comprises a processor, a non-transitory memory, and an input output device; initiating, by the unit controller, a start-up procedure comprising an automatic diagnostic process further comprising at least one diagnostic test selected from the group consisting of a readiness diagnostic test, an intake manifold test, and an discharge manifold test; performing the diagnostic test; determining a set of results of the diagnostic test; comparing a set of results of the diagnostic test to an operational indicator set, determining a health status of one or more components of the pump unit based upon the comparison of the set of results of the diagnostic test and the operational indicator set; initiating a repair and scheduling maintenance of the one or more components of the pump unit in response to a fail status within the health status; or pumping a wellbore treatment into the wellbore in response to a passing status of the health status of one or more components of the pump unit.

A nineteenth embodiment, which is the method of the eighteenth embodiment, wherein the readiness diagnostic test comprises a communication check, an operation check, a calibration check, or combinations thereof, wherein the communication check comprises communicating with various components of the pump unit, wherein the operation check comprises actuating the various components, and wherein the calibration check comprises access a calibration file of the various components.

A twentieth embodiment, which is the method of the eighteenth embodiment, wherein the intake manifold diagnostic test comprises: configuring a flow path comprising a sensor valve and a supply pump, wherein the supply pump provides a flow rate through the sensor valve; performing the diagnostic test, wherein the diagnostic test comprises: positioning the sensor valve in a fully open position; operating the supply pump to communicate a fluid via the flow path at full speed; closing a valve on a return line; and measuring, by the sensor valve, a first periodic dataset while the fluid is communicated via the flow path with the sensor valve in the fully open position and the valve on the return line is in the fully closed position.

A twenty-first embodiment, which is the method of the eighteenth embodiment, wherein the discharge manifold diagnostic test comprises: coupling a high pressure supply line between a discharge hub and a test block with a closed valve; setting an emergency release value (ERV); operating a plunger pump to pump a volume of water and apply a target pressure value to the test block via the high pressure supply line; and measuring, by at least one sensor, a first periodic dataset of pressure.

A twenty-second embodiment, which is the method of any of the eighteenth through the twenty-first embodiments, further comprising determining, by the unit controller, a probability of a future maintenance event in response to the set of results of the diagnostic test, a pump usage log, a pump maintenance log, or combinations thereof.

A twenty-third embodiment, which is the method of the twenty-second embodiment, wherein the probability of a future maintenance event is determined by a predictive maintenance model.

A twenty-fourth embodiment, which is the method of the twenty-second embodiment or the twenty-third embodiment, further comprising assigning, by the unit controller, the pump unit to a maintenance schedule at a service center in response to the probability of a future maintenance event.

A twenty-fifth embodiment, which is a system of wellbore pumping unit, comprising: a wellbore pumping unit comprising a discharge manifold coupled to a plunger pump; a unit controller comprising a processor, a non-transitory memory, and an automatic diagnostic process executing in memory, configured to: perform a discharge manifold diagnostic test, wherein the diagnostic test comprises: operating a plunger pump to pump a volume of water and apply a target pressure value to the test block via the high pressure supply line; and measuring, by at least one sensor, a first periodic dataset of pressure; compare, by the unit controller or a remote computer, a result of the diagnostic test to an operational indicator set, determine, by the unit controller or the remote computer, a health status of the discharge manifold based upon the comparison of the result of the diagnostic test and the operational indicator set; and output, by the unit controller, of the health status of the discharge manifold, wherein the health status of the discharge manifold a visual cue, and audible cue, or both.

A twenty-sixth embodiment, which is the system of the twenty-fifth embodiment, further comprising: selectively positioning, by the unit controller, the sensor valve in a first position or a second position, wherein the first position fluidically couples a first discharge manifold with a second discharge manifold, and wherein the second position decouples the first discharge manifold from the second discharge manifold.

A twenty-seventh embodiment, which is the system of the twenty-sixth embodiment, wherein the discharge manifold diagnostic test is applied to the first discharge manifold and the second discharge manifold in response to the unit controller positioning the sensor valve in the first position.

A twenty-eighth embodiment, which is the system of any of the twenty-fifth through the twenty-seventh embodiments, further comprising a remote computer in communication with the unit controller via a wireless communication protocol.

A twenty-ninth embodiment, which is the system of the twenty-eighth embodiment, wherein the wireless communication protocol is at least one of a 5G, a long-term evolution (LTE), a code division multiple access (CDMA), or a global system for mobile communications (GSM) telecommunications protocol.

A thirtieth embodiment, which is the system of any of the twenty-fifth through the twenty-ninth embodiments, wherein the wellbore pumping unit is a mud pump, a cement pumping unit, a blender unit, a water supply unit, or a fracturing pump.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A wellbore servicing method comprising:

transporting a pump unit to a wellsite, wherein the pump unit comprises a unit controller configured to perform a diagnostic test, wherein the unit controller comprises a processor, a non-transitory memory, and an input output device;

initiating, by the unit controller, a start-up procedure comprising an automatic diagnostic process comprising at least one diagnostic test selected from the group consisting of a readiness diagnostic test, an intake manifold test, and a discharge manifold test;

performing the diagnostic test, comprising measuring, by a sensor valve of the pump unit, a first periodic dataset while fluid is communicated via a flow path with the sensor valve in a fully open position and a valve on a return line of the pump unit is in a fully closed position;

determining a set of results of the diagnostic test;

comparing the set of results of the diagnostic test to an operational indicator set;

determining a health status of one or more components of the pump unit based upon the comparison of the set of results of the diagnostic test to the operational indicator set; and controlling the pump unit to pump cement into the wellbore, in response to the determined health status being a passing health status.

2. The method of claim 1, wherein the readiness diagnostic test comprises a communication check, an operation check, a calibration check, or combinations thereof, wherein the communication check comprises communicating with components of the pump unit, wherein the operation check comprises actuating the components, and wherein the calibration check comprises accessing a calibration file of the components.

3. The method of claim 1, wherein the intake manifold diagnostic test further comprises:

configuring a flow path comprising a sensor valve and a supply pump, wherein the supply pump provides a flow rate through the sensor valve;

performing the diagnostic test, wherein the diagnostic test comprises:

positioning the sensor valve in a fully open position;

operating the supply pump to communicate a fluid via the flow path at full speed; and closing a valve on a return line.

4. The method of claim 1, wherein the discharge manifold diagnostic test comprises:

coupling a high pressure supply line between a discharge hub and a test block with a closed valve;

setting an emergency release value (ERV);

operating a plunger pump to pump a volume of water and apply a target pressure value to the test block via the high pressure supply line; and measuring, by at least one sensor, a first periodic dataset of pressure.

5. The method of claim 1, further comprising determining, by the unit controller, a probability of a future maintenance event in response to the set of results of the diagnostic test, a pump usage log, a pump maintenance log, or combinations thereof.

6. The method of claim 5, wherein the probability of a future maintenance event is determined by a predictive maintenance model.

7. The method of claim 5, further comprising assigning, by the unit controller, the pump unit to a maintenance schedule at a service center in response to the probability of a future maintenance event.

8. A system of wellbore pumping unit, comprising:

a wellbore pumping unit comprising a discharge manifold coupled to a plunger pump; and a unit controller comprising a processor, a non-transitory memory, and an automatic diagnostic process executing in memory, configured to:

perform a discharge manifold diagnostic test, wherein the diagnostic test comprises:

operating a plunger pump to pump a volume of water and apply a target pressure value to a test block via a high pressure supply line; and measuring, by at least one sensor, a first periodic dataset of pressure;

compare, by the unit controller or a remote computer, a result of the diagnostic test to an operational indicator set;

determine a health status of the discharge manifold based upon the comparison of the result of the diagnostic test and the operational indicator set; and control the pumping unit to pump cement into a wellbore, in response to the determined health status being a passing health status.

9. The system of claim 8, wherein the unit controller is configured to selectively position the sensor valve in a first position or a second position, wherein the first position fluidically couples a first discharge manifold with a second discharge manifold, and wherein the second position decouples the first discharge manifold from the second discharge manifold.

10. The system of claim 9, wherein the discharge manifold diagnostic test is applied to the first discharge manifold and the second discharge manifold in response to the unit controller positioning the sensor valve in the first position.

11. The system of claim 8, further comprising a remote computer in communication with the unit controller via a wireless communication protocol.

12. The system of claim 11, wherein the wireless communication protocol is at least one of a 5G, a long-term evolution (LTE), a code division multiple access (CDMA), or a global system for mobile communications (GSM) telecommunications protocol.

13. The system of claim 8, wherein the wellbore pumping unit is a mud pump, a cement pumping unit, a blender unit, a water supply unit, or a fracturing pump.

14. A computer-implemented method of determining a health status of a pumping equipment system within a wellbore pump unit, the method comprising:

initiating, by a unit controller, a diagnostic process comprising at least one diagnostic test, wherein the unit controller comprises a processor, a non-transitory memory, and an input output device;

performing, by the unit controller, the at least one diagnostic test which comprises measuring, by a sensor valve of the pump unit, a first periodic dataset while fluid is communicated via a flow path with the sensor valve in a fully open position and a valve on a return line of the pump unit is in a fully closed position;

determining, by the diagnostic process, a set of results of the diagnostic test;

comparing the set of results of the diagnostic test to an operational indicator set;

determining the health status of the pumping equipment system based upon the comparison; and controlling, by the unit controller, the pump unit to pump cement into the wellbore, in response to the determined health status being a passing health status.

15. The method of claim 14, wherein the at least one diagnostic test comprises:

configuring a plurality of sensor valves to configure a piping network;

filling the piping network with a volume of water;

operating a pump to establish 1) a flowrate of water, 2) a target pressure value, or 3) both;

measuring, by at least one sensor, a periodic dataset; and storing the periodic dataset, wherein the periodic dataset is associated with the operation of the pump and the configuration of the piping network.

16. The method of claim 14, wherein the at least one diagnostic test further comprises:

configuring a flow path through a piping network by positioning a plurality of sensor valves into a first flow path position, wherein the flow path includes an intake header located between a high pressure line and a fluid end; and operating a supply pump at full speed to communicate a fluid via the flow path and closing a valve coupled to a return line.

17. The method of claim 14, wherein the at least one diagnostic test further comprises:

coupling a high pressure supply line between a discharge hub and a test block with a closed valve;

setting an emergency release value (ERV);

operating a plunger pump to pump a volume of water and apply a target pressure value to the test block via the high pressure supply line; and measuring, by at least one sensor, a first periodic dataset of pressure.

18. The method of claim 17, wherein the diagnostic process is configured to stop the plunger pump, disengage a power end from a fluid end, engage a break on a drive shaft of the power end, open a pressure relief valve, or combinations thereof in response to the ERV value being exceeded by the plunger pump.

19. The method of claim 14, further comprising determining, by the unit controller, a probability of a future maintenance event in response to the set of results of the diagnostic test, a pump usage log, a pump maintenance log, or combinations thereof.

20. The method of claim 19, wherein the probability of a future maintenance event is determined by a predictive maintenance model.

* * * * *